US006571986B1

(12) United States Patent
Simmons

(10) Patent No.: US 6,571,986 B1
(45) Date of Patent: Jun. 3, 2003

(54) QUICK CHANGE ROLL-FED HIGH SPEED LABELING SYSTEM HAVING A SEGMENTED CONSTRUCTION

(75) Inventor: James Simmons, Modesto, CA (US)

(73) Assignee: Impaxx Machines Systems, Inc., Fullerton, CA (US)

( * ) Notice: Subject to any disclaimer, the term of this patent is extended or adjusted under 35 U.S.C. 154(b) by 28 days.

(21) Appl. No.: 10/035,920

(22) Filed: Oct. 18, 2001

Related U.S. Application Data

(60) Provisional application No. 60/241,399, filed on Oct. 18, 2000.

(51) Int. Cl.[7] ..... G07F 11/00

(52) U.S. Cl. ..... 221/79; 156/449

(58) Field of Search ..... 221/70, 75, 76, 221/79, 119, 277, 278; 156/449, 446, 456, 566

(56) References Cited

U.S. PATENT DOCUMENTS 4,729,811 A * 3/1988 DiFrank ..... 156/449

* cited by examiner

*Primary Examiner*—Kenneth W. Noland
(74) *Attorney, Agent, or Firm*—Stout, Uxa, Buyan & Mullins, LLP; Donald E. Stout

(57) ABSTRACT

A quick-change roll-fed labeling machine system includes a conveyor for moving articles to be labeled, an infeed screw assembly for spacing and stabilizing the articles, a rotatable starwheel assembly having a plurality of spaced pockets for receiving individual ones of the articles therein, a rotatable vacuum drum assembly, and a supply of roll fed labels, wherein the labels are dispensed singly onto a label receiving face of the rotatable vacuum drum assembly. Both the starwheel assembly and the vacuum drum assembly comprise a plurality of segments for convenient change-out when necessary.

2 Claims, 30 Drawing Sheets

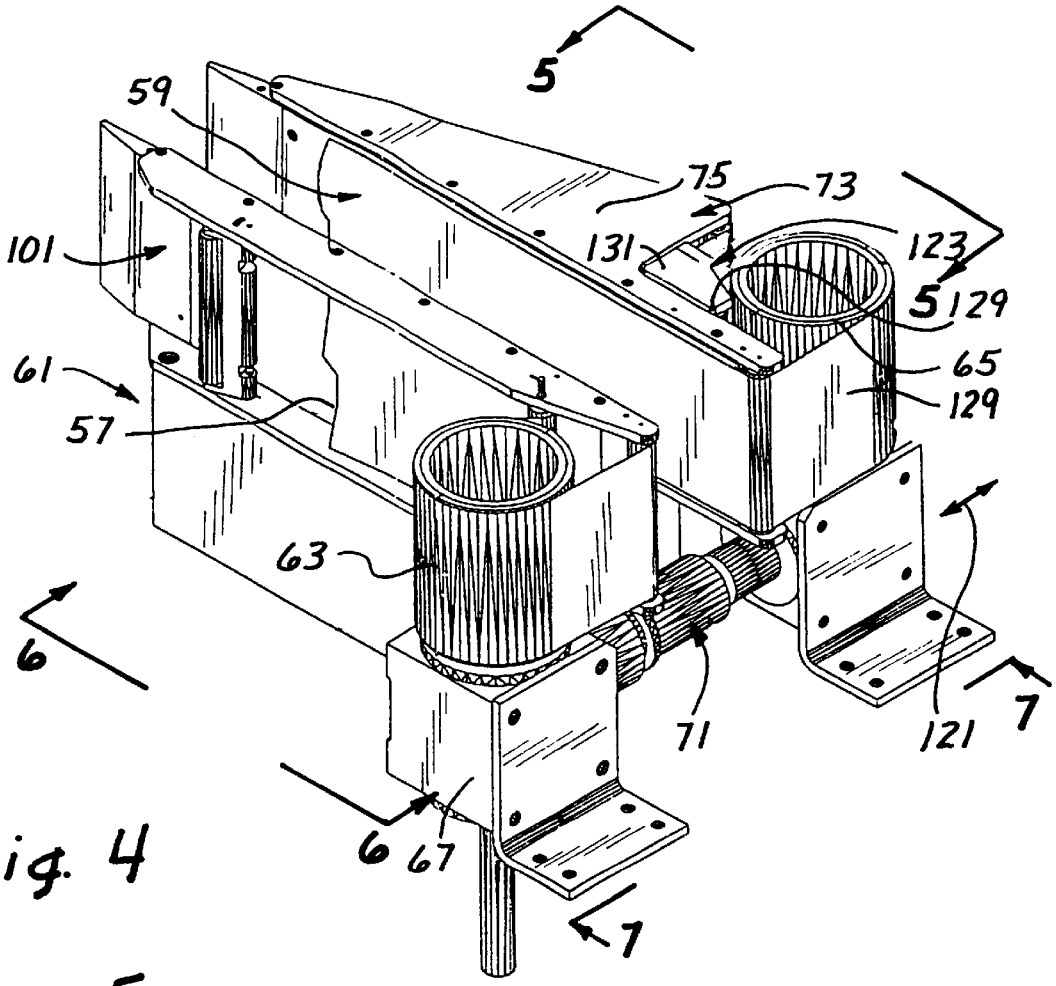
Fig. 4
Fig. 5
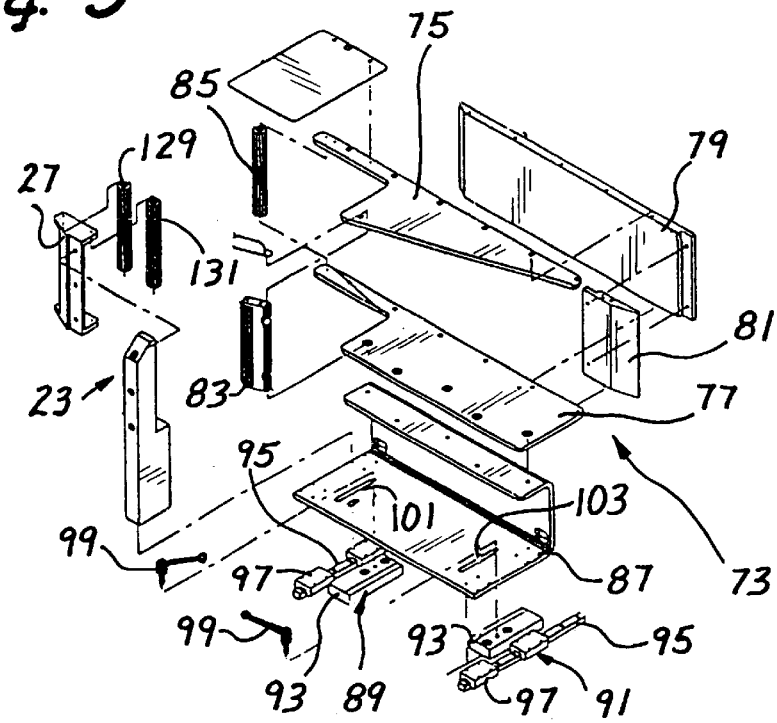

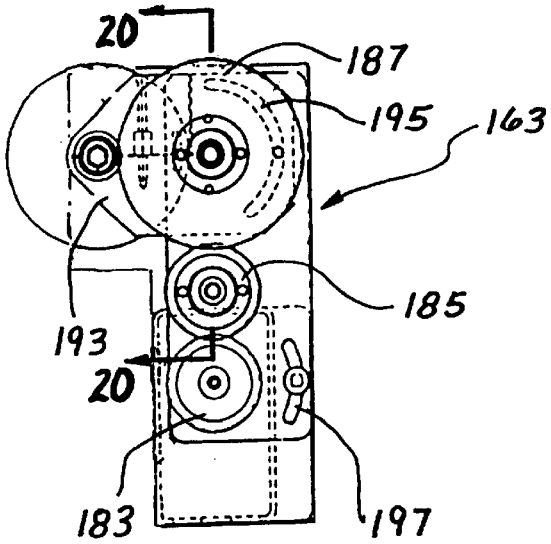
Fig. 18
Fig. 19
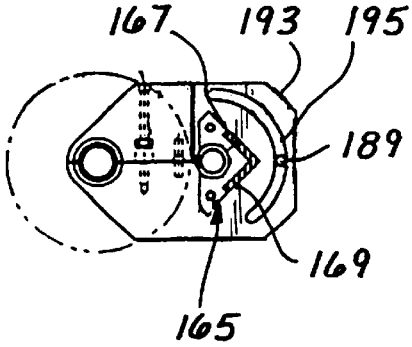
Fig. 20
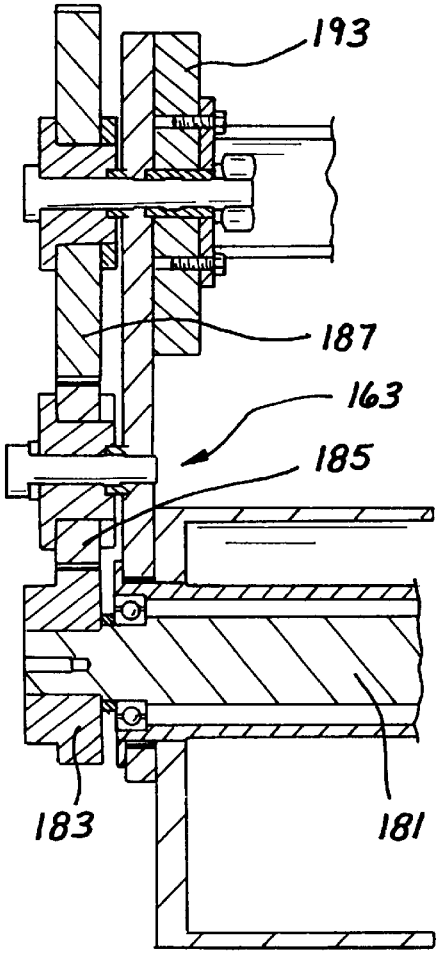

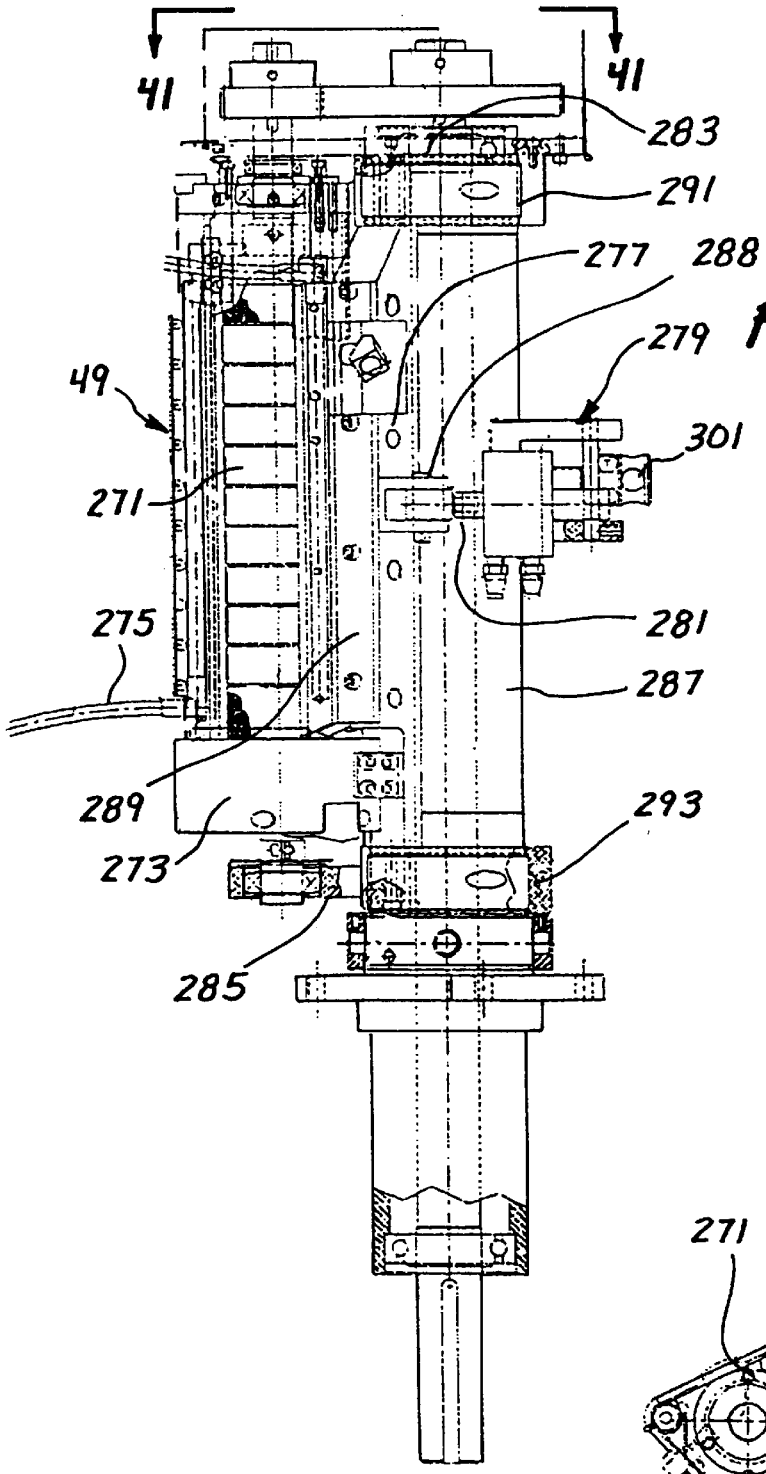
Fig. 40
Fig. 41
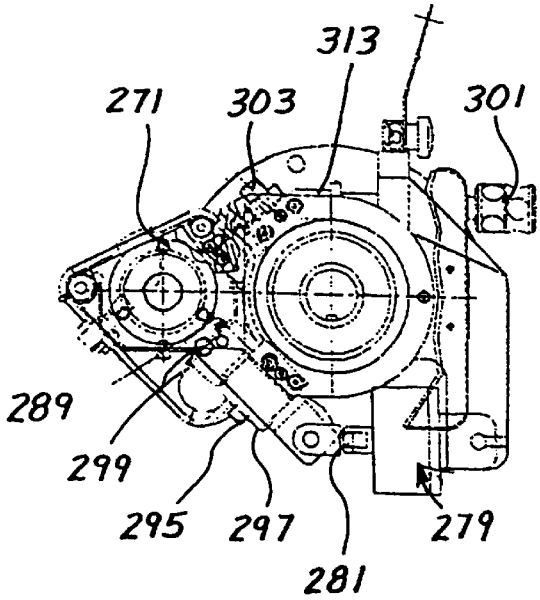

QUICK CHANGE ROLL-FED HIGH SPEED LABELING SYSTEM HAVING A SEGMENTED CONSTRUCTION

This application claims the benefit of U.S. Provisional Application Serial No. 60/241,399, filed Oct. 18, 2000, which is commonly owned and the contents of which are expressly incorporated herein by reference.

BACKGROUND OF THE INVENTION

This invention relates generally to labeling machines for applying adhesive-backed labels to containers, and more particularly to a quick change roll-fed high speed labeling machine and methods for use thereof, which comprises innovative quick change parts and a significantly improved vacuum drum system.

High speed packaging machinery is essential to meet large demands for consumer products in a market-oriented economy. As a consequence, there is a need for machinery that can satisfy mass market packaging requirements swiftly, inexpensively, and without interruption. Machinery of this character also must satisfy further needs, among which are safe and reliable operation by relatively unskilled production personnel.

SUMMARY OF THE INVENTION

The present invention comprises a new quick-change roll-fed labeling machine which employes a unique container flow path resulting in higher labeling speed and precision label placement.

More particularly, there is provided a quick change roll-fed high speed labeling system, which comprises a conveyor for moving articles to be labeled. Additionally, the inventive system includes an infeed screw assembly for spacing and stabilizing the articles. Additional system elements include a rotatable starwheel assembly having a plurality of spaced pockets for receiving individual ones of the articles therein, a rotatable vacuum drum assembly, and a supply of roll fed labels, wherein the labels are dispensed singly onto a label receiving face of the rotatable vacuum drum assembly. Advantageously, the starwheel assembly comprises a plurality of segments for convenient change-out when necessary.

In another aspect of the invention, there is provided a quick change roll-fed high speed labeling system, which comprises a conveyor for moving articles to be labeled. Additionally, the inventive system includes an infeed screw assembly for spacing and stabilizing the articles, and a rotatable starwheel assembly having a plurality of spaced pockets for receiving individual ones of the articles therein. A glue wheel is disposed adjacent to the vacuum drum assembly for selectively applying glue to labels disposed on the vacuum drum assembly. Advantageously, the vacuum drum assembly comprises a plurality of segments for convenient change-out when necessary.

The invention, together with additional features and advantages thereof, may best be understood by reference to the following description taken in conjunction with the accompanying illustrative drawing.

BRIEF DESCRIPTION OF THE DRAWINGS

FIG. 4 is a perspective view in isolation of the stabilizer belt assembly of the labeling machine illustrated in FIGS. 1–3;

FIG. 5 is an exploded view taken along lines 5—5 of FIG. 4;

FIG. 18 is a left side view of the assembly of FIG. 17;

FIG. 19 is a view taken along lines 19—19 of FIG. 17;

FIG. 20 is a cross-sectional view taken along lines 20—20 of FIG. 18;

FIG. 40 is an elevational view of the glue roller assembly of the present invention;

FIG. 41 is a top view of the glue roller assembly, taken along lines 41—41 of FIG. 40;

DESCRIPTION OF THE PREFERRED EMBODIMENT

Figure 1:
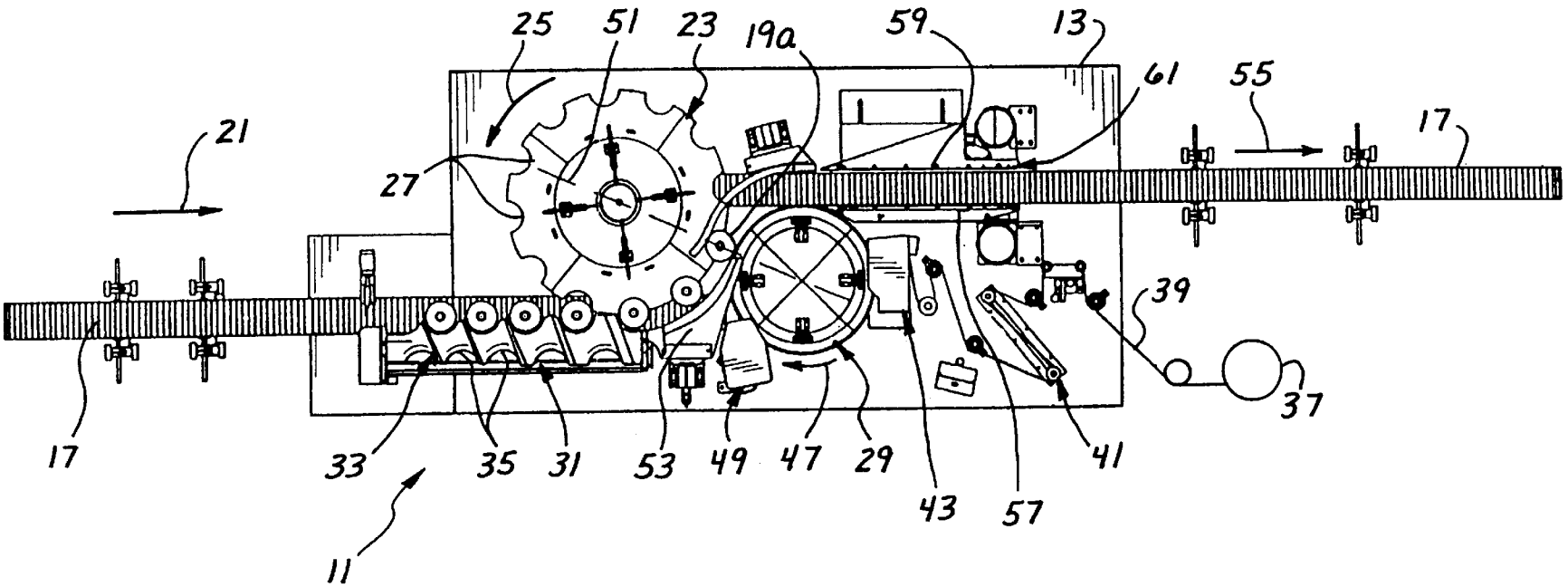
FIG. 1 is a schematic top view of a labeling machine which incorporates the features of the invention.
Figure 2:
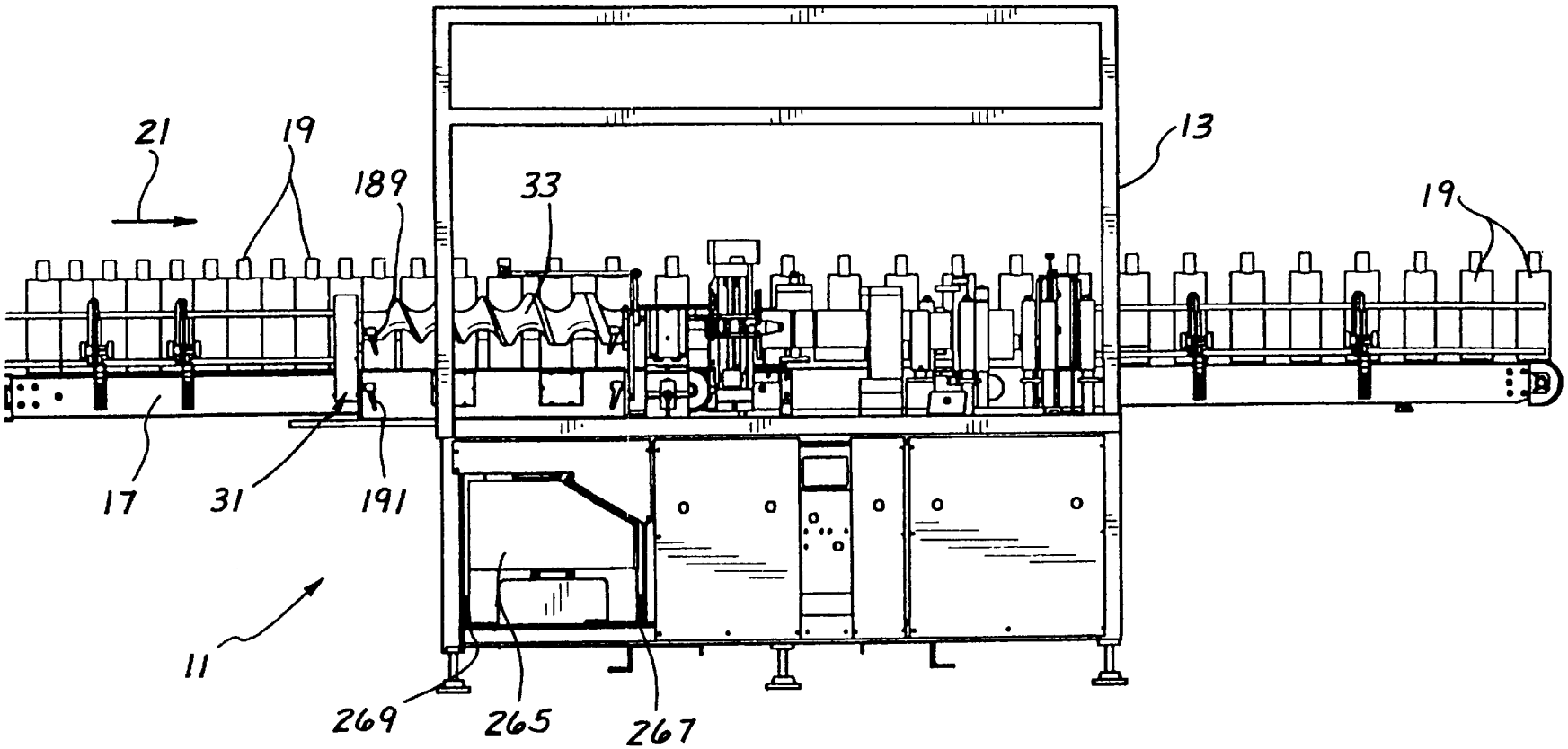
FIG. 2 is a front view of the labeling machine illustrated in FIG. 1.
Figure 3:
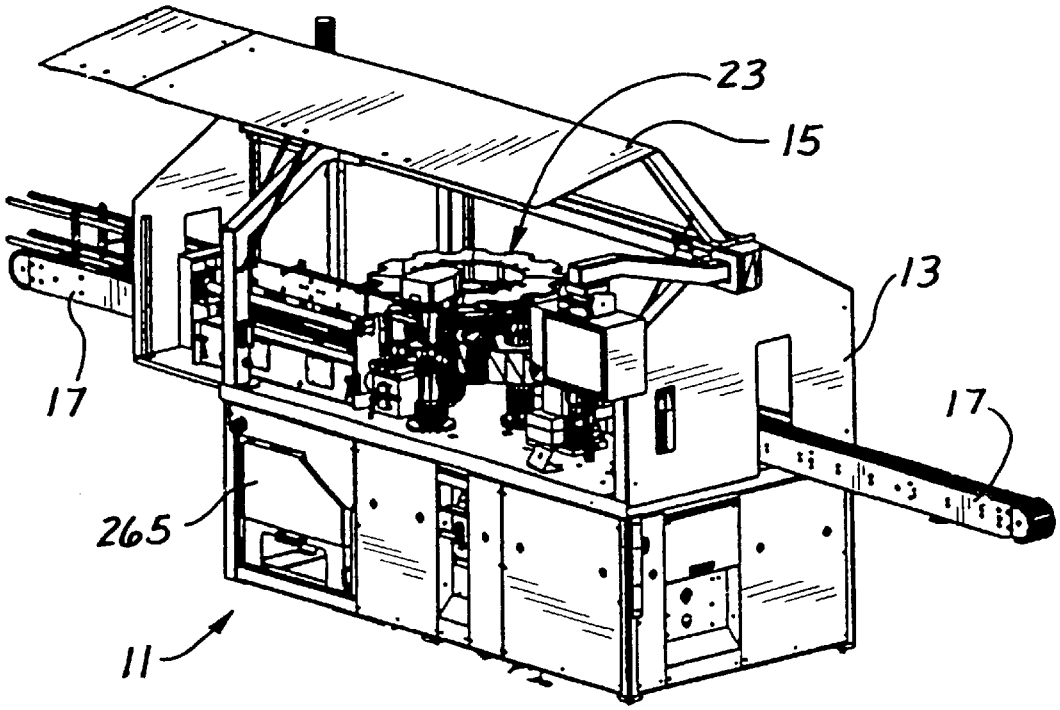
FIG. 3 is a perspective view of the labeling machine illustrated in FIGS. 1 and 2.

Now with reference more particularly to the drawings, there is shown in FIGS. 1–3 a labeling machine 11 for feeding cut labels onto containers fed along a conveyor. The labeling machine 11 preferably comprises a Series 4700 roll fed labeling machine manufactured and sold by Trine Labelling Systems, a division of. Impaxx Machine Systems, Inc. of Fullerton, Calif., the assignee of the present inventions, although the inventions described below are suitable for use with many other labeling systems.

For a greater understanding of the principles of the labeling machine, its general operation will be briefly explained, again with particular reference to FIGS. 1–3. The labeling machine 11 comprises a housing 13 having a hinged cover 15 for accessing its interior. A link belt conveyor 17 moves containers or product packages 19 toward the labeling machine 11 in the direction of the arrow 21. The labeling machine is designed to apply labels to containers that have a broad range of sizes, or diameters in the case of cylindrical containers 19. For example, in a preferred embodiment of the inventive machine, containers having a range of diameters between 2 and 5 inches can be accommodated.

Containers 19 on the conveyor 17 are first received in the labeling machine 11 by a starwheel assembly 23. The starwheel assembly 23, which will be described subsequently in greater detail, rotates in a direction illustrated by arrow 25 (FIG. 1), and receives the containers 19 one-by-one in successive pockets 27, moving them in the direction of the arrow 21 toward a vacuum drum assembly 29, which functions as a label applying station, in a manner to be described below. An infeed screw assembly 31 comprises, in part, a rotating feedscrew 33, which also includes a plurality of pockets 35 for receiving individual containers 19 as they travel into the machine 11. A primary purpose for the feedscrew 33 is to ensure that the containers 19 spaced in a regulated manner prior to their contact with the starwheel assembly 23, so that they feed into the starwheel pockets 27 without jamming.

A roll of labels 37 provide a web 39 of labels that is drawn through a feed roller system, indicated generally at 41, to the cutter assembly 43. The cutter assembly 43 is in close proximity to the vacuum drum assembly 29, and is adapted to operate in conjunction therewith. In brief, the vacuum drum assembly 29 includes a vacuum draw system for drawing a vacuum along its perforated surface to engage the label web 39 and move it into contact with a knife edge positioned adjacent to a cutter roll (not shown) within the cutter assembly. A labeling cutting blade engages the knife edge to cut the web 39. The vacuum draw in the cutter roll maintains the cut label on the roll surface until it reaches a point where the label is transferred to the label drum by reducing the vacuum and blowing ajet of air outwardly from the cutter roll to assist in label transfer.

Figure 38:
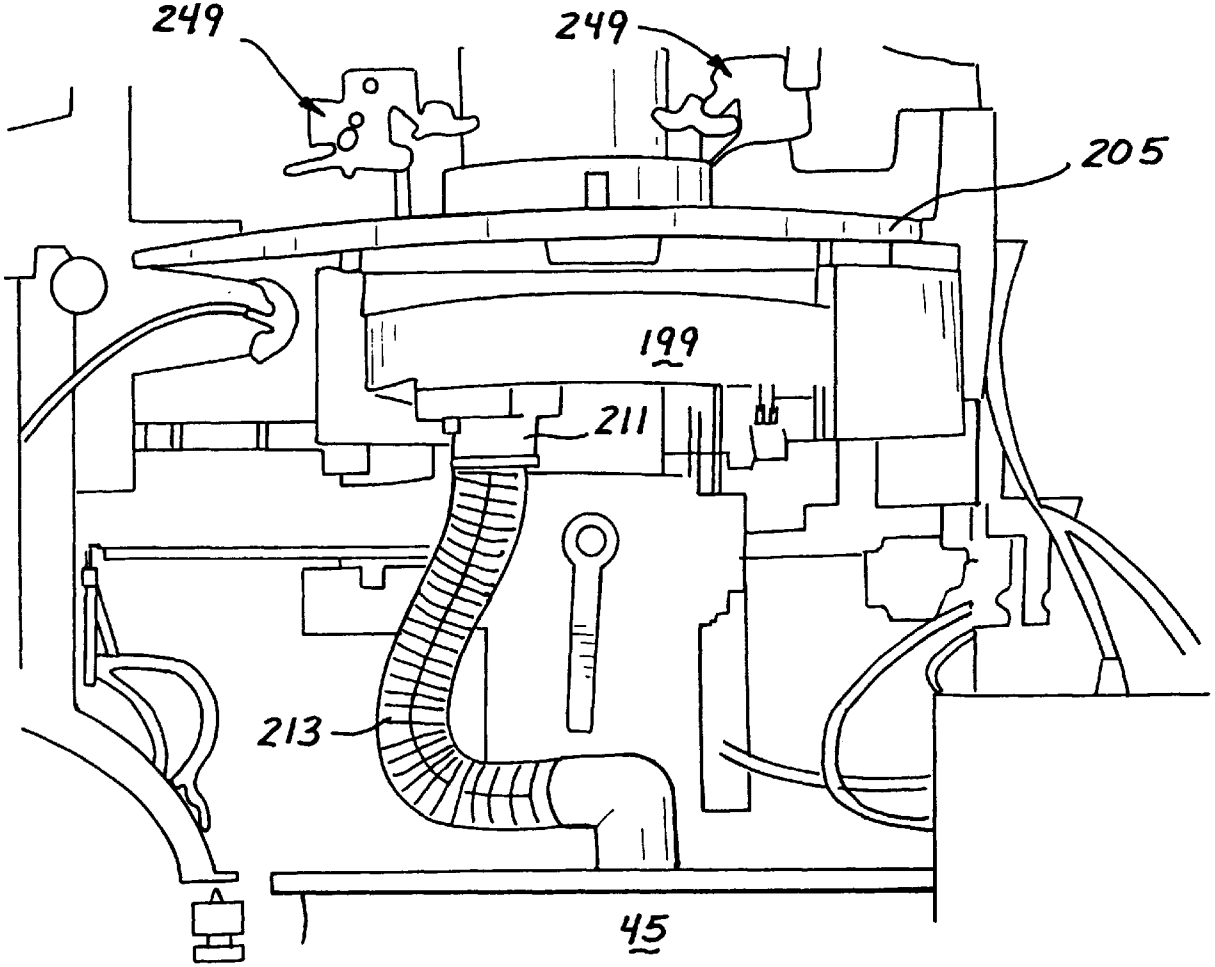
FIG. 38 is an elevation illustrating a lower portion of the vacuum drum assembly of the present invention, and in particular the vacuum hose connection to the vacuum valve.

Still referring particularly to FIGS. 1 and 2, the severed labels are received onto the vacuum drum assembly 29, which also has vacuum drawn by a vacuum source 45 (FIG. 38) through vacuum channels to vacuum orifices on the surface of the label drum, to be described in much greater detail hereinbelow, to retain the label thereon as the label drum rotates. A drive mechanism (not shown) is operatively connected in well known fashion to the vacuum drum assembly 29 and provides the motive force for rotating the drum assembly. In preferred embodiments, the labels on the drum are rotated in the direction of the arrow 47 to a glue applicator assembly 49 (FIG. 1). Glue is applied to a portion of the surface of the label that is exposed on the drum 29 by the glue applicator 49. The drum 29 rotates the leading edge of the glued label until it is approximately in alignment with an imaginary line 51 between the rotational axis of the vacuum drum 29 and the starwheel assembly 23. In FIG. 1, for example, container 19*a* is illustrated as being at this labeling point.

This imaginary line 51 also coincides with the termination of an arcuate infeed guide 53 (FIG. 1). The container 19*a* in the pocket or cusp 27 of the starwheel 23 is pushed by the starwheel into engagement with the leading edge of the label and the label wraps itself around the container 19*a*, which container continues counter-clockwise rotation, in known fashion, to complete the labeling process.

The purpose of the infeed guide 53 is to serve, in combination with the starwheel assembly 23, to present the container 19*a* squarely to the vacuum drum assembly 29 when the container 19*a* first contacts the label.

Once the container 19*a* has been labeled, it exits the labeling machine 19 in the direction of arrow 55 (FIG. 1), by traveling along the conveyor belt 17 between a pair of stabilizer belts 57, 59, respectively, which together form a stabilizer belt assembly 61. The purpose of this assembly 61, of course, is to stabilize the containers on the conveyor 17, to prevent falling of the containers and to ensure that there is a smooth progression to a downstream location, for packaging or further processing, which may include a heating step, for example, if the labels are of the shrink wrap variety. As will be described hereinbelow, the belt 59 is adjustably positioned so that the spacing between belts 57, 59 may be varied to account for containers of various sizes.

Now with reference particularly to FIGS. 4–8, the novel adjustability feature with respect to the stabilizer belt assembly 61 will be discussed in greater detail. The stabilizer belt assembly 61 comprises a pair of drive pulleys 63, 65 about which each belt 57, 59 is secured, respectively. The drive pulleys are rotatable in order to drive the belts in an axial direction, as is known in the art. Bevel gear drives 67, 69 function to rotatably drive the pulleys. A coupling axle 71 ensures that the two bevel gear drives are driven together, so that, in turn, the belts 57, 59 operate synchronously.

FIG. 5 illustrates, in exploded fashion, the support mechanism 73 for the drive belt 59, in reverse orientation from that seen in FIG. 4. This mechanism 73 includes a movable top plate 75 and a movable bottom plate 77. A nosebar plate 79, nosebar 81, tensioner assembly 83, and idler 85 join the top and bottom movable plates 75 and 77 together. This movable plate assembly, in turn, is mounted on a movable base 87. The movable base 87 is slidably disposed on a pair of Thomson bearing assemblies 89 and 91, one on each end of the movable base 87. Each Thomson bearing assembly 89, 91 comprises a lock block 93, a Thomson linear slide rail 95, and a Thomson recirculating ball carriage 97. Such Thomson bearing assemblies are well known in the art, and are commercially available. Each assembly 89, 91 also comprises a "Carr-Lane" locking handle 99 which is insertable, as shown, through a respective slot 101, 103 and mechanically attachable to a respective lock block 93, to thereby mount the movable base in slidable fashion to the respective Thomson bearing assemblies 89, 91.

Of course, as is apparent to those of ordinary skill in the art, the belt 59, when fully assembled to the support mechanism 73, will extend axially over the nosebar plate 79, in a vertical orientation.

Figure 6:
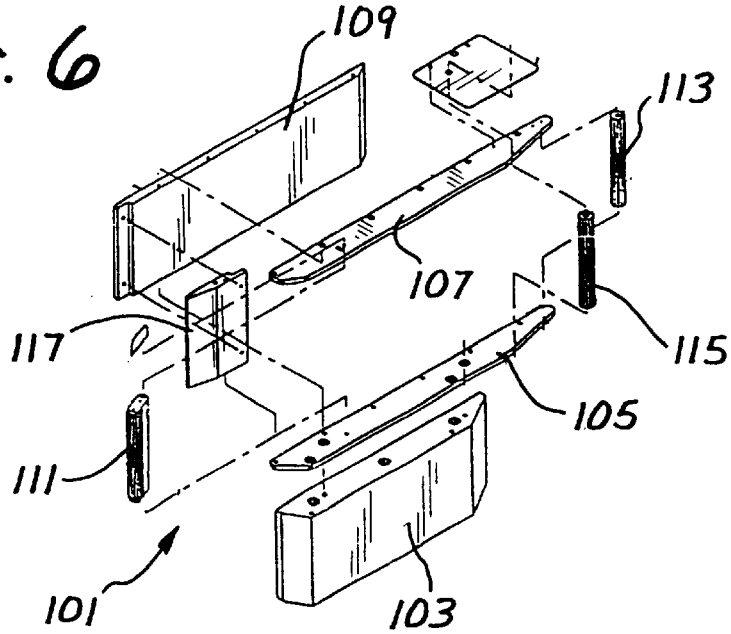
FIG. 6 is an exploded view taken along lines 6—6 of FIG. 4.
Figure 7:
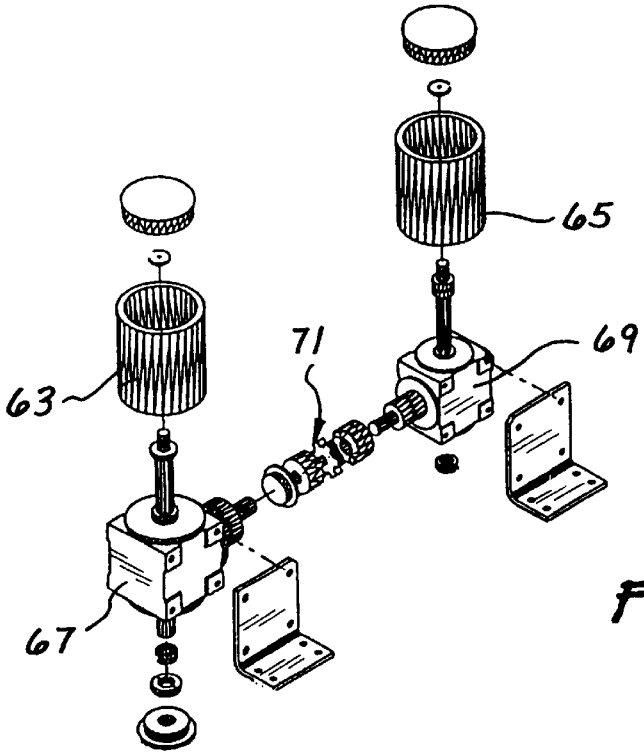
FIG. 7 is an exploded view taken along lines 7—7 of FIG. 4.
Figure 10:
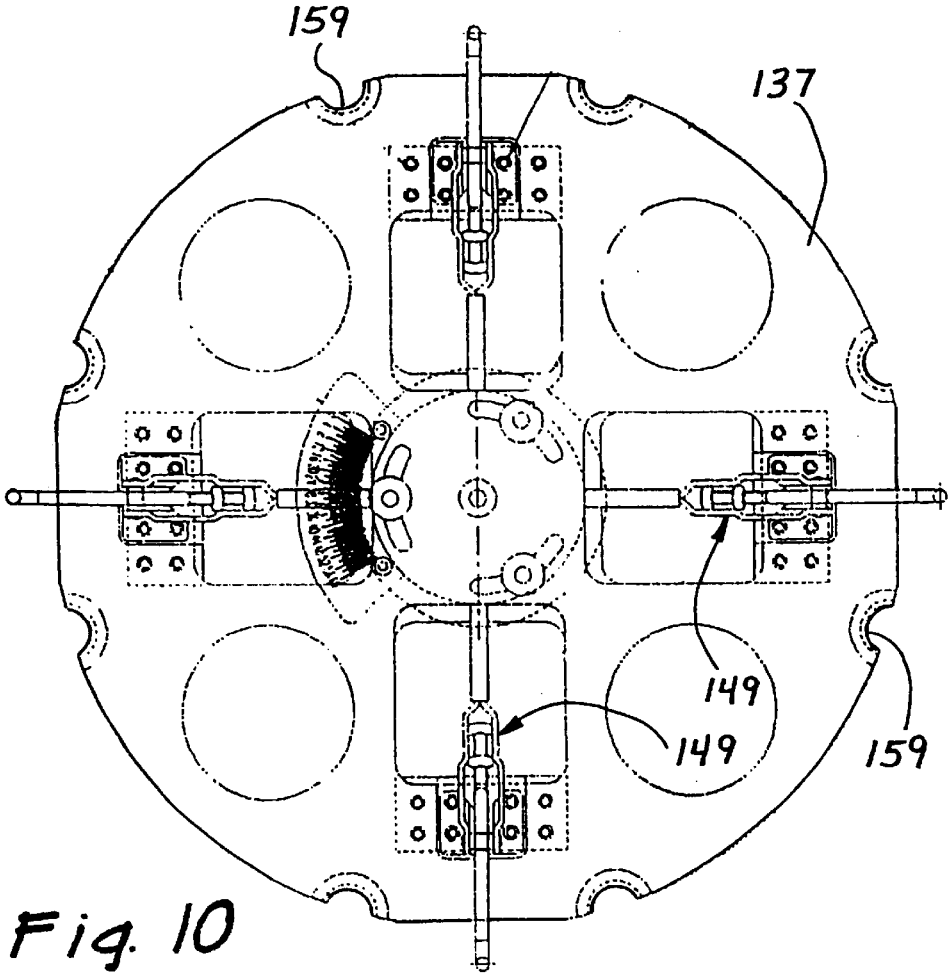
FIG. 10 is a top plan view of the starwheel assembly illustrated in FIG. 9.

FIG. 6 illustrates the construction of a stationary support assembly 101 for the belt 57. The assembly 101 comprises a stationary base 103, stationary bottom plate 105, a stationary top plate 107, a nosebar plate 109, tensioner 111, idlers 113, 115, a nosebar 117, and a stationary guard 119, assembled as shown.

Figure 8:
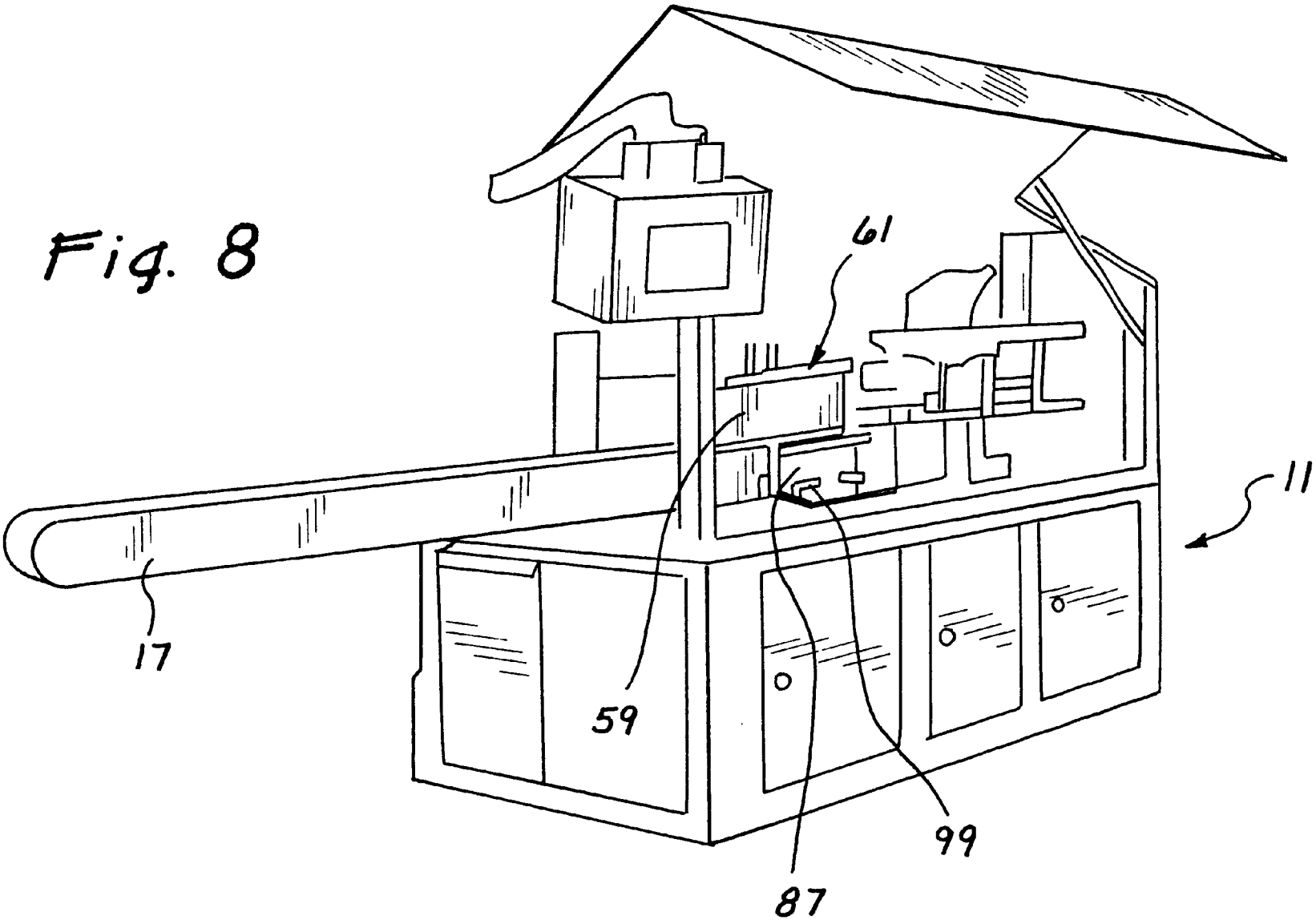
FIG. 8 is a perspective view of the labeling machine illustrated in FIGS. 1–3, which illustrates a portion of a Thomsen bearing assembly which comprises an important part of the inventive stabilizer belt assembly.
Figure 9:
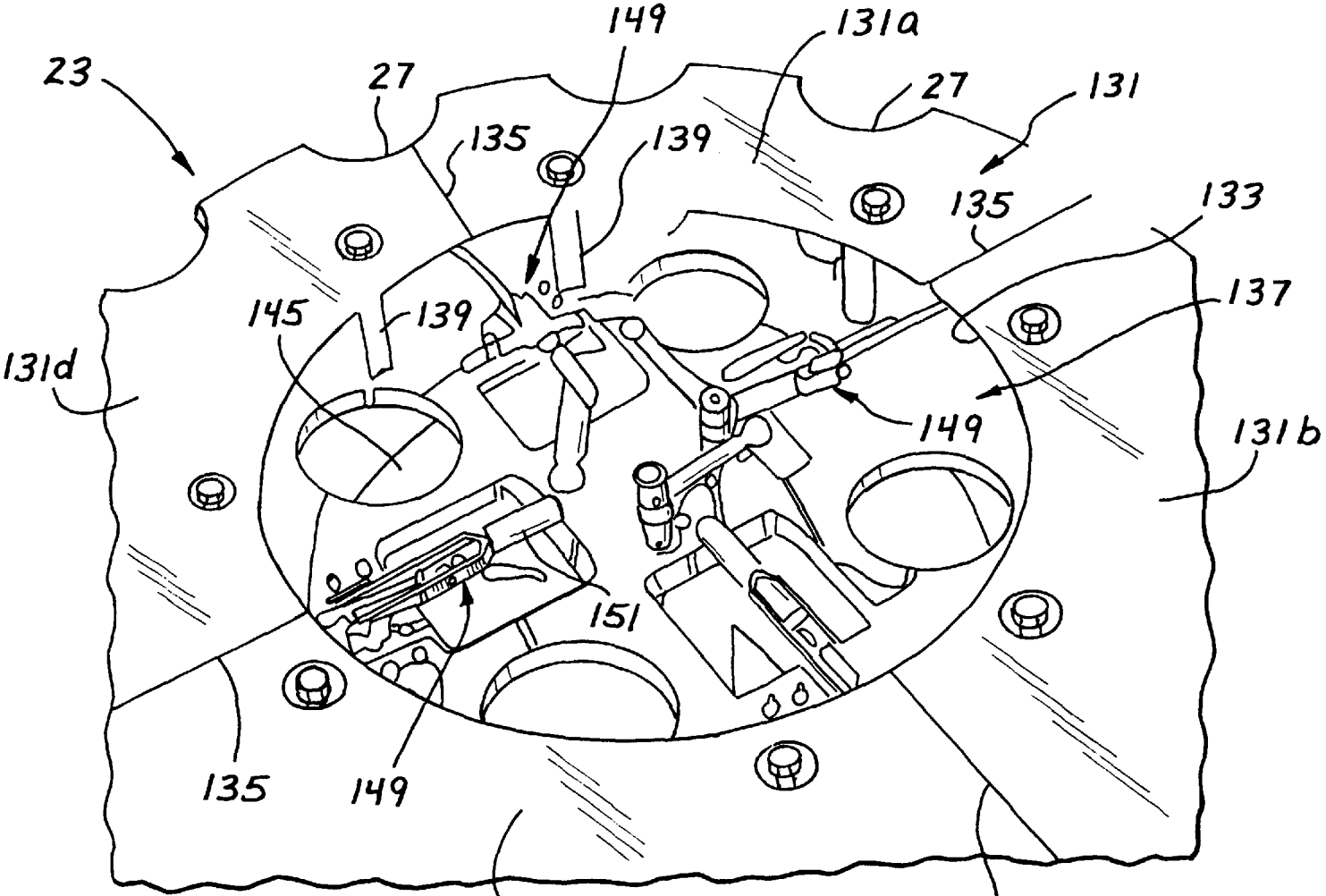
FIG. 9 is a perspective top view of a portion of the starwheel assembly which forms a part of the inventive labeling machine.
Figure 11:
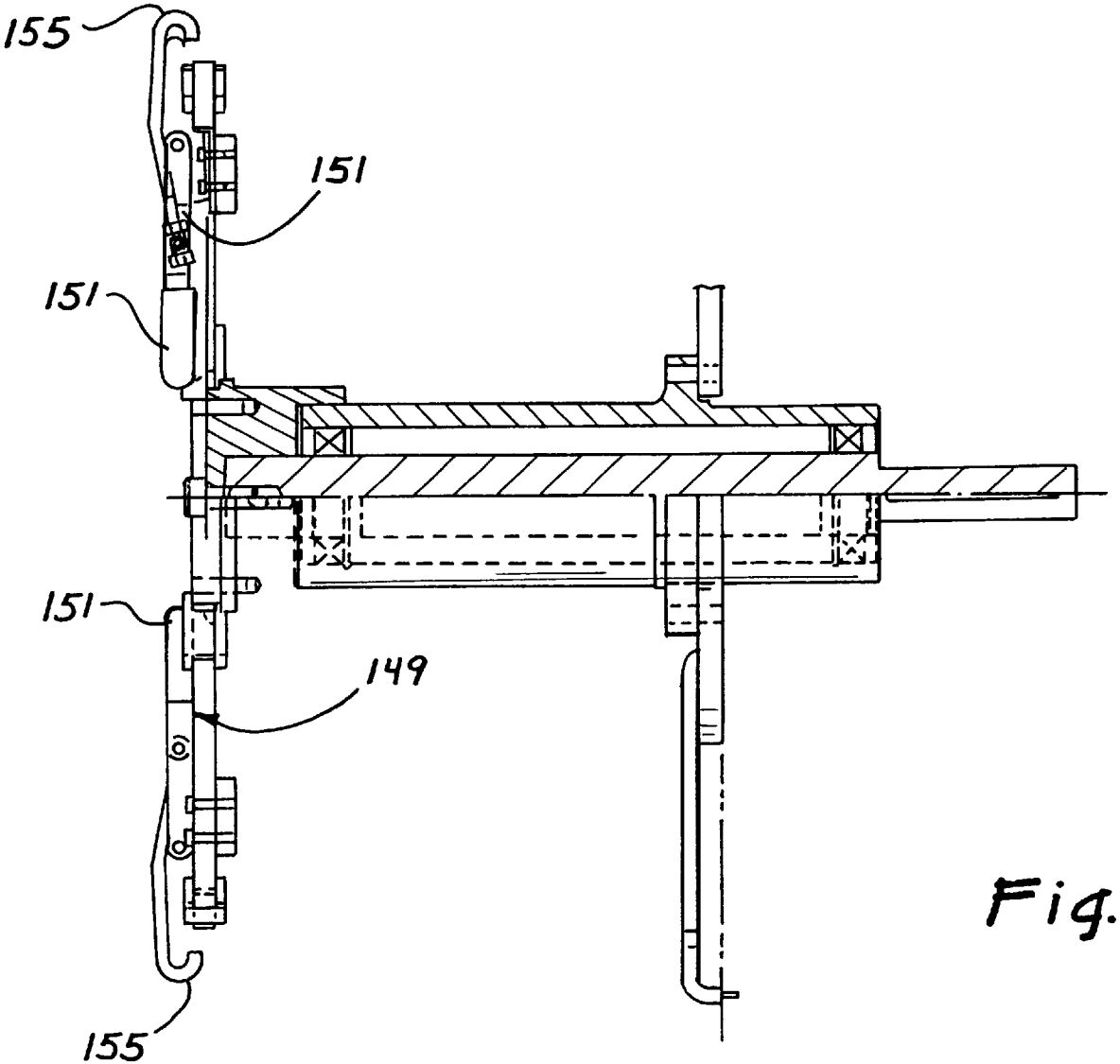
FIG. 11 is a cross-sectional view taken from the right side of the starwheel assembly illustrated in FIG. 10.

With reference now to FIG. 8, which shows the machine 11 from the operator's side, the movable base 87 which supports the stabilizer belt assembly 61 is illustrated. In prior art configurations, when it is desired to label containers of various sizes (and, in particular, various diameters, in the case of generally cylindrical containers), it has been necessary to move the belt 59 outwardly or inwardly in a direction transverse to that of the direction of travel of the containers 19, for the purpose of adjusting the spacing between the belts 57 and 59 to accommodate the desired container size. Such an operation involves the complex disassembly and reassembly of the belt mechanism, and re-tensioning of the belt 59, which is a labor and time intensive process.

The advantage of the present inventive configuration is that the belt 59 need not be re-tensioned at all. All that need be done is to simply slide the belt support mechanism 73 inwardly or outwardly, as desired, by loosening the two locking handles 99 and moving the movable base and associated components to any position along the length of the slot 101, 103, by means of the provided Thomson bearing assemblies 89. When the belt 59 is in its new desired position, relative to the belt 57, the handles 99 are conveniently re-tightened by the operator, so that the mechanism 73 is secured in that new location. Advantageously, instead of a 15 minute procedure, under typical circumstances, only 1 minute or less is required for the change, and the belt tension is unchanged, requiring no re-adjustment.

Referring again to FIG. 4, it is noted that the mechanism 73 moves in accordance with the double-headed arrow 121, in either direction, as desired. Importantly, the movable top and bottom plates 75, 77, respectively, move with the mechanism 73 along the Thomson slide rails 95. However, the drive pulley 65 and idler assembly 123, comprising an idler mounting post 125, an idler shoe 127, and idlers 129, 131 (FIG. 5), remain stationary when the mechanism 73 is moved. Thus, stabilizer belt portion 129 (FIG. 4) is shortened when the mechanism 73 is moved outwardly toward the drive pulley 65, and lengthened when the mechanism 73 is moved inwardly. This phenomenon functions to maintain constant belt tension no matter which position it assumes.

In the preferred embodiment, the total distance through which the mechanism 73 can be moved inwardly and outwardly is approximately 3 inches, to accommodate containers having cross-sections of approximately 2–5 inches. Of course, these dimensions may be changed as desired, to suit a particular application.

Now with reference particularly to FIGS. 9–16, the construction and function of the starwheel assembly 23 will be further discussed. In this type of machine 11, which is designed to accommodate containers 19 of various sizes, a number of machine components are "change parts", meaning that they must be changed out when a different sized container is to be labeled. It is important that these "change parts" be designed to be easily changeable quickly, in order to minimize labor costs and downtime associated with the changeover. Accordingly, the present invention includes a novel and innovative starwheel assembly construction which greatly simplifies the changeout process.

Figure 12:
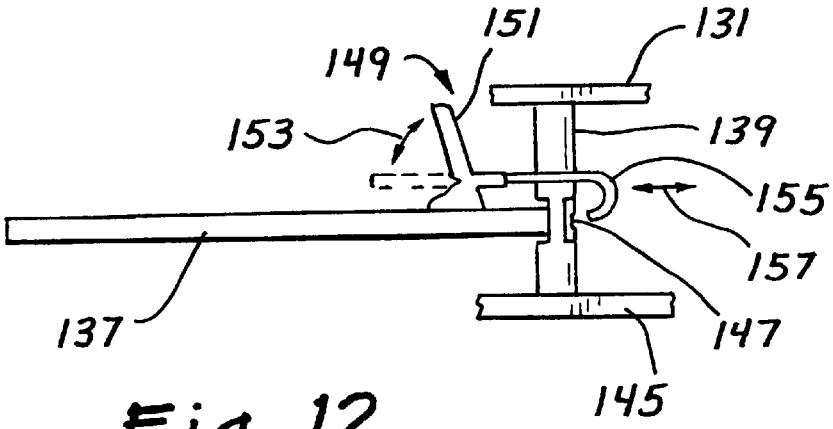
FIG. 12 is a schematic plan view of a portion of the inventive mechanism for assembling segments of the starwheel assembly of the present invention.
Figure 13:
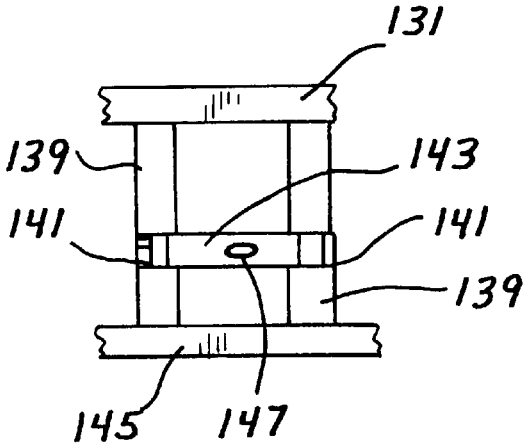
FIG. 13 is a schematic side view of the assembly portion illustrated in FIG. 12.

As shown in the aforementioned drawing figures, the starwheel assembly 23 comprises an upper starwheel 131 which is annular, having a large center aperture 133 and the previously mentioned pockets 27 on an outer periphery thereof. This upper starwheel 131 is divided into a plurality of segments 131*a*, 131*b*, 131*c*, 131*d*, which in the preferred embodiment comprise four, though more or fewer segments could be employed. The advantage of this segmented construction is that the aforementioned quick changes can be readily accomplished by a single technician, because each segment is relatively lightweight. Break lines 135, as shown, for example, in FIG. 9, define the four segments. A permanent starwheel flange 137 is disposed beneath the upper starwheel, and is attached to the upper starwheel 131 by means of posts 139. This arrangement is best shown in FIGS. 12 and 13, wherein it is seen that the posts 139 have recesses 141 on their outer surfaces for receiving an end of a cross-member or bar 143. The lower ends of the posts 139 are secured to a lower starwheel 145. Bars 143 each include an aperture 147 disposed on a center portion thereof, as shown in FIG. 13. A clamping mechanism 149 is disposed on the flange 137, as shown in FIG. 12, for securing the post 139 and bar 143, and thus the starwheels 131 and 145, to the flange 137. Each segment of the starwheel assembly includes a clamping mechanism 149, which, in its preferred embodiment, comprises a DeStaco™ clamp.

Figure 14:
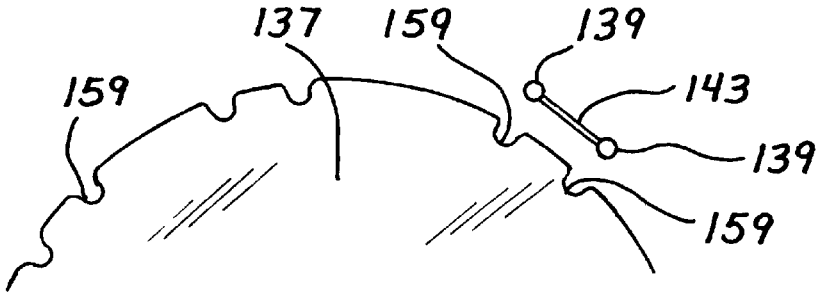
FIG. 14 is a schematic top view of the assembly portion illustrated in FIG. 12.
Figure 15:
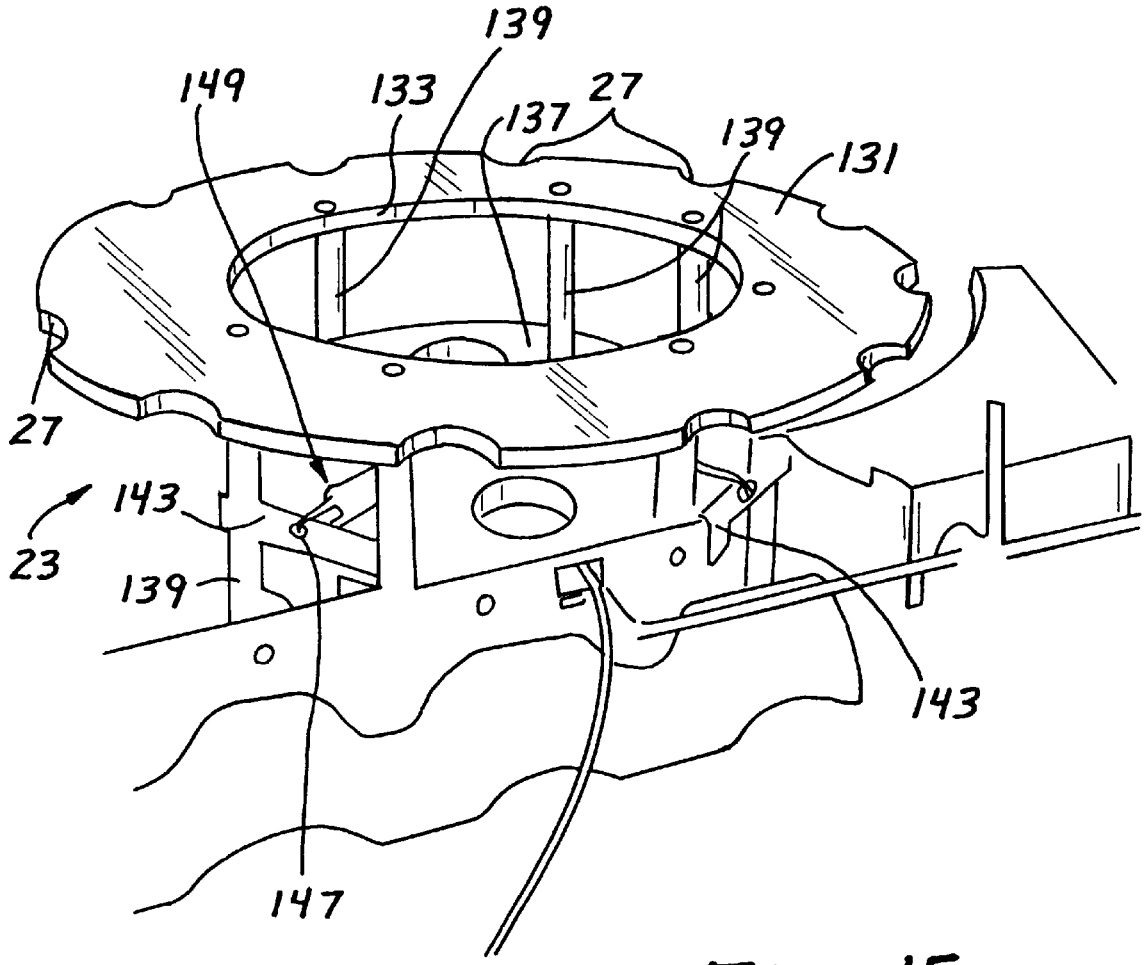
FIG. 15 is a perspective view illustrating the starwheel assembly.
Figure 16:
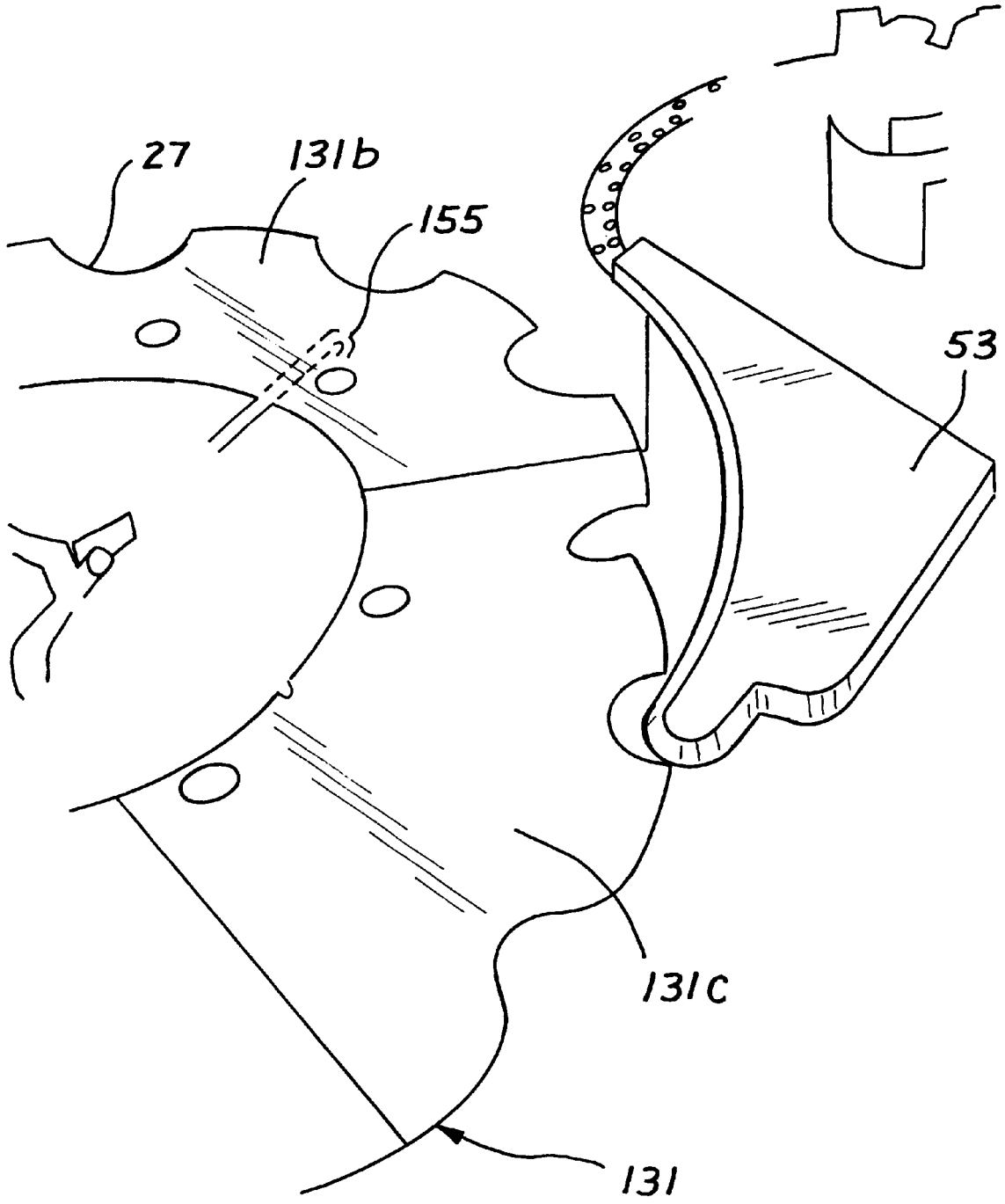
FIG. 16 is a perspective top view of the labeling cavity of the present invention.
Figure 17:
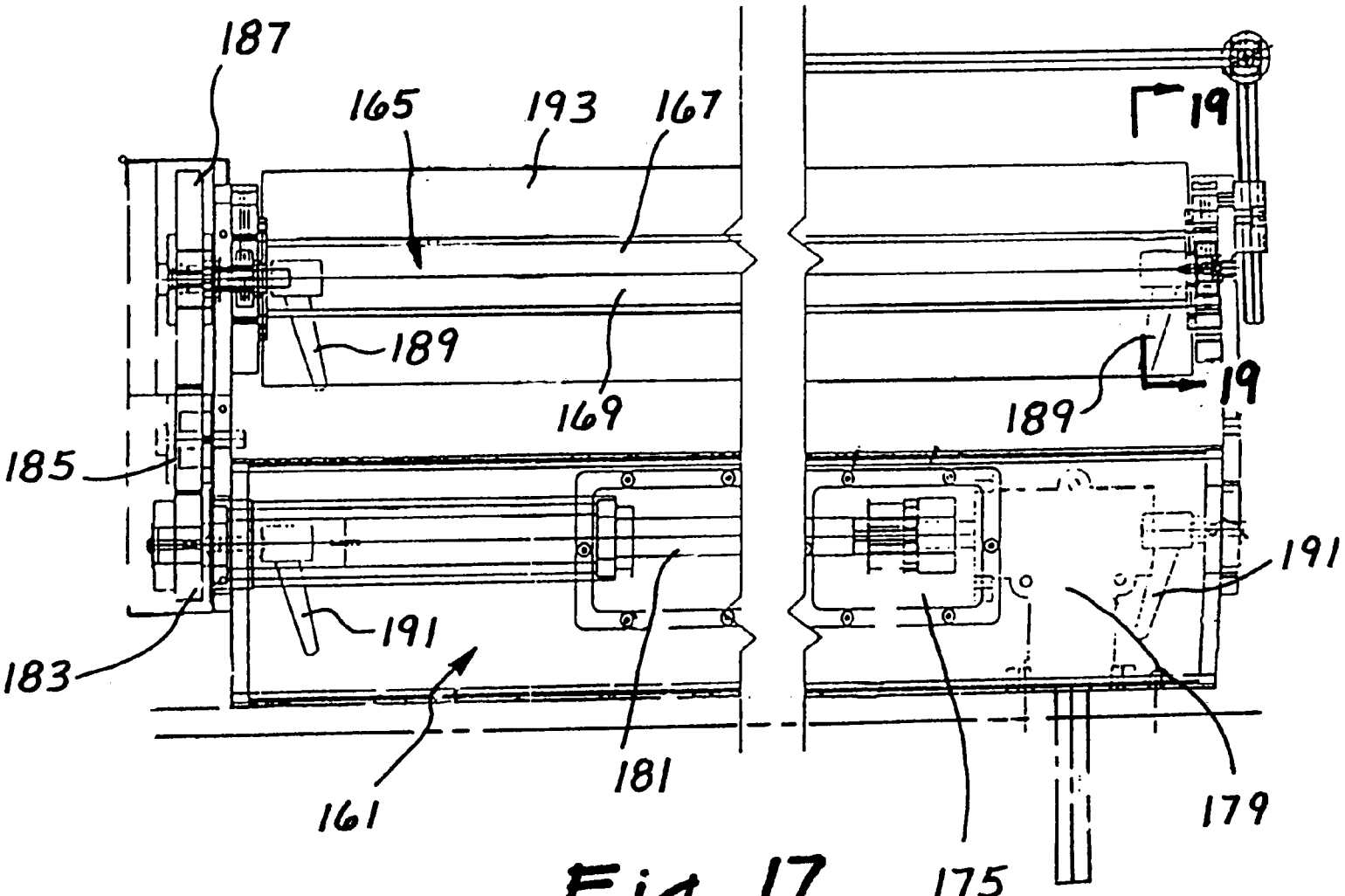
FIG. 17 is a front plan view of the feedscrew drive assembly of the present invention.

The clamping mechanism 149 preferably comprises a handle portion 151, which may be actuated between the solid and phantom positions shown in FIG. 12, along arrow 153, to move a hook portion 155 linearly in accordance with the arrow 157, so that the hook portion 155 can be engaged into the aperture 147 on the bar 143. When the handle 153 is retracted into the phantom position, the hook 155 will be engaged into the aperture 147, to thereby secure a segment of the starwheel assembly to the flange 137. This process is completed for each of the four segments, meaning that a clamping mechanism is actuated to cause a hook portion 155 to engage a corresponding bar 143. As shown in FIG. 14, an outer periphery of the permanent flange 137 includes a plurality of spaced notches 159, which are adapted to accommodate and receive the posts 139.

Thus, when it is desired to change out a starwheel assembly 23, the technician need only disengage each of the four clamping mechanisms 149 from their respective bars, by actuating the handle portion 151 thereof to move the hook portion 155 linearly outwardly to disengage from its corresponding aperture 147. This will disengage each of the starwheel segments 131 a, b, c, d from the permanent flange 137. A different starwheel may then be quickly installed and assembled by reversing these steps, i.e. engaging each of the four clamping mechanisms 149 in the manner above described.

Figure 21:
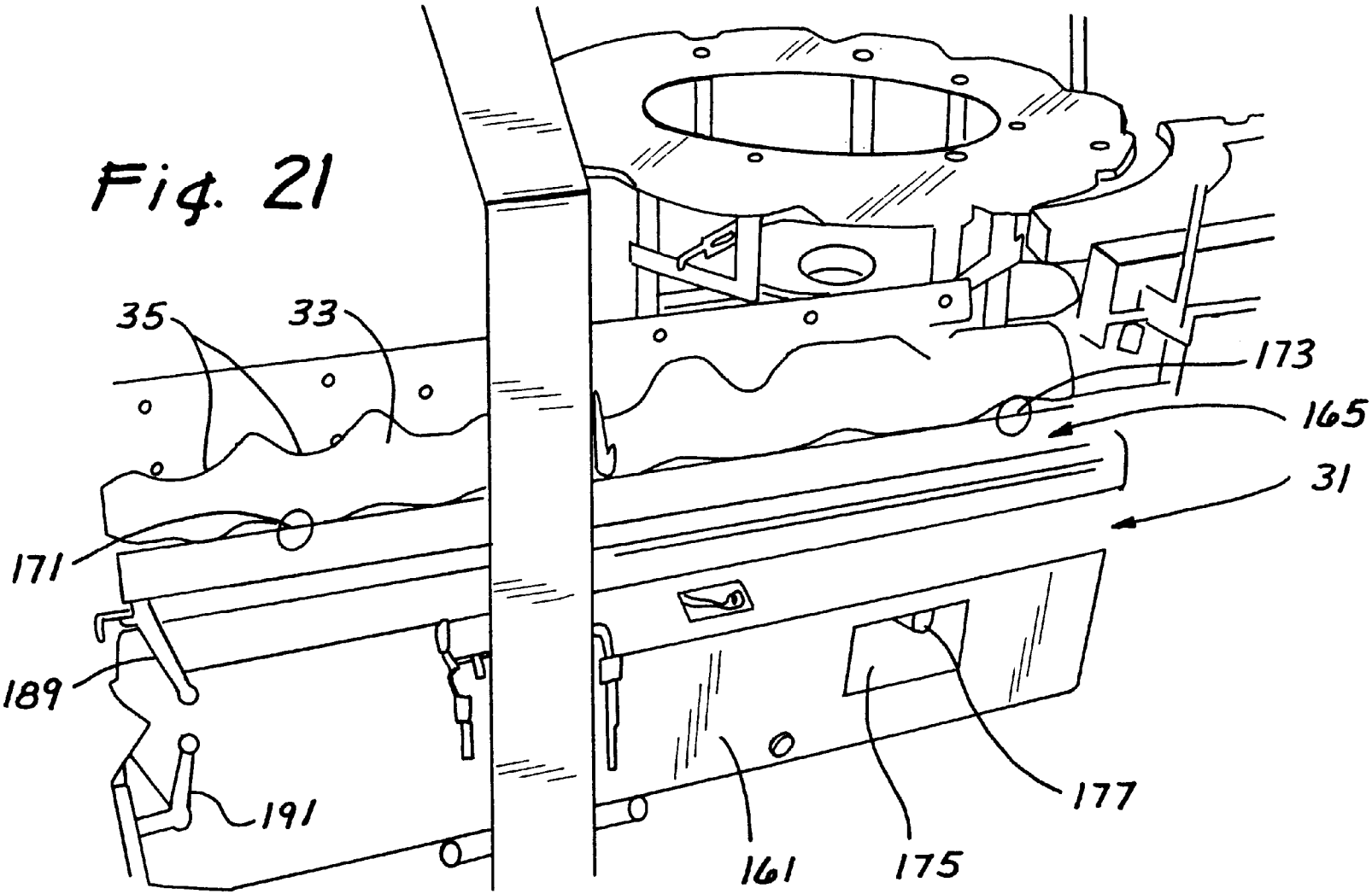
FIG. 21 is a front perspective view of the infeed screw assembly of the present invention.

Referring now more particularly to FIGS. 17–21, yet another unique feature of the present invention, involving the infeed screw assembly of the inventive machine 11, will be described. As shown in FIGS. 1 and 21, the infeed screw assembly 31 comprises a feedscrew 33 having a plurality of pockets 35 for receiving and properly spacing successive incoming containers 19. It is important that the feedscrew 33 be positioned so that the pockets 35 contact the containers 19 at a location slightly below the center of gravity of the containers. Therefore, the inventors have determined that it is important to be able to adjust the feedscrew elevation, to account for varying container heights, and horizontal orientation to account for container diameter variations. It should also be noted that the feedscrew 33 is a change part when containers of significantly different cross-sectional dimensions (diameters) are labeled. This is because a different pocket size is required. (Note that the pitch of the feedscrew preferably remains constant regardless of the container size).

The infeed screw assembly 31 comprises a drive housing 161, which preferably comprises a square tube fabricated of steel or the like. The feedscrew drive mechanism 163 (FIGS. 18 and 20) is disposed within the drive housing 161, where it is well protected from debris and unintended impacts. Above the drive housing 161, and just proximally of and partially beneath the feedscrew 33, is a cradle bar 165, preferably comprised of a stiff material, such as steel, with two angled faces 167, 169. Fixed cradle bar handles 171, 173 are provided on either end of the cradle bar 165, for use by the machine operator in a manner to be described below. An access opening 175 is provided in the drive housing 161, for operator access to feedscrew drive controls 177.

The feedscrew drive mechanism advantageously comprises, rather than a belt or chain drive as in the prior art, a gear drive. This permits avoidance of the need to frequently adjust belt tension, creating numerous downtime intervals. The gear drive comprises, in a presently preferred embodiment, a right angle gearbox 179 for transferring power from a drive motor (not shown) to a jack shaft 181. The jack shaft 181 rotatably drives a Browning gear 183, preferably phenolic, which in turn, in a geartrain, drives a second Browning idler gear 185, preferably steel, and associated idler bushing, and a third Browning gear 187, also preferably phenolic, which rotatably drives the feedscrew 33.

To achieve the aforementioned ability to adjust the feedscrew elevation and horizontal orientation, two upper clamp handles 189 on either side of the infeed screw assembly 31 are provided to permit a vertical pivoting capability, and two lower clamp handles 191 on either side of the infeed screw assembly are provided to permit a horizontal pivoting capability. A cradle houses the feedscrew 33, and is pivoted in a vertical orientation when the handles 189 are loosened, permitting a range of motion through the length of an arcuate slot 195 (FIGS. 18 and 19) into which each handle 189 is engaged. Similarly, an arcuate slot 197 (FIG. 18) engages each of the handles 191, thereby providing a horizontal range of motion through which the feedscrew assembly can be pivoted. When the operator wishes to adjust the orientation of the feedscrew, i.e. articulate the feedscrew, he or she can grasp the fixed handles 171, 173 on the cradle bar 165 for support and leverage, loosen the appropriate handle sets, articulate the feedscrew assembly through a desired range of motion, then re-tighten the loosened handles to secure the new orientation.

Now the inventive vacuum drum assembly will be further described, in conjunction particularly with FIGS. 22–39. The vacuum drum assembly 29 employs a number of novel and advantageous features. For example, the vacuum drum pads of assembly 29 are change parts, because of various label sizes and desired elevation of the label on the container. Therefore, the inventors have designed a segmented vacuum drum pad assembly, similar in some respects to the segmented starwheel assembly, to simplify the change out process, permitting a lightweight, quick change. Positive lever locks assist this quick change procedure and help to maintain alignment. Additionally, optimized vacuum porting assists in significantly reducing drum contamination over prior art configurations.

Figure 22:
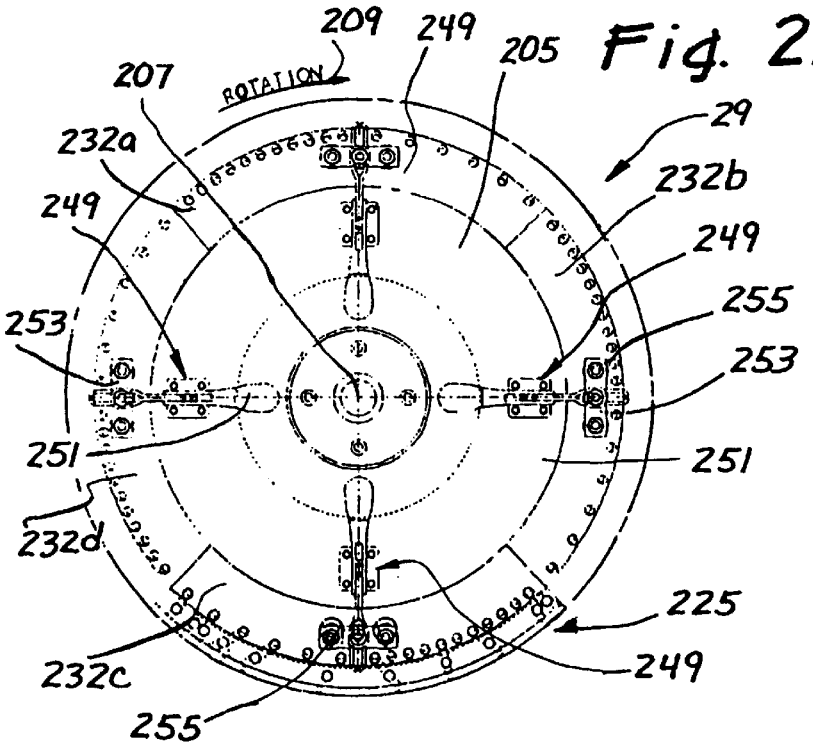
FIG. 22 is a top view of the vacuum drum assembly of the present invention.
Figure 24:
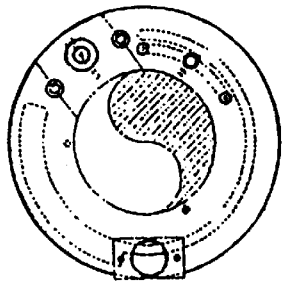
FIG. 24 is a view taken along lines 24—24 of FIG. 23.
Figure 23:
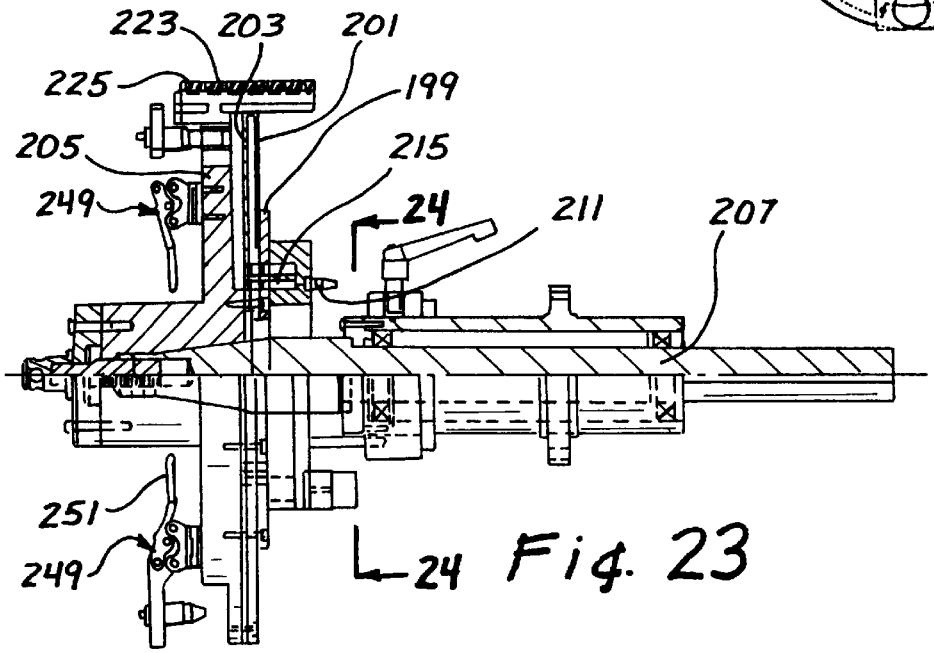
FIG. 23 is a cross-sectional side view of the vacuum drum assembly of FIG. 22.
Figure 26:
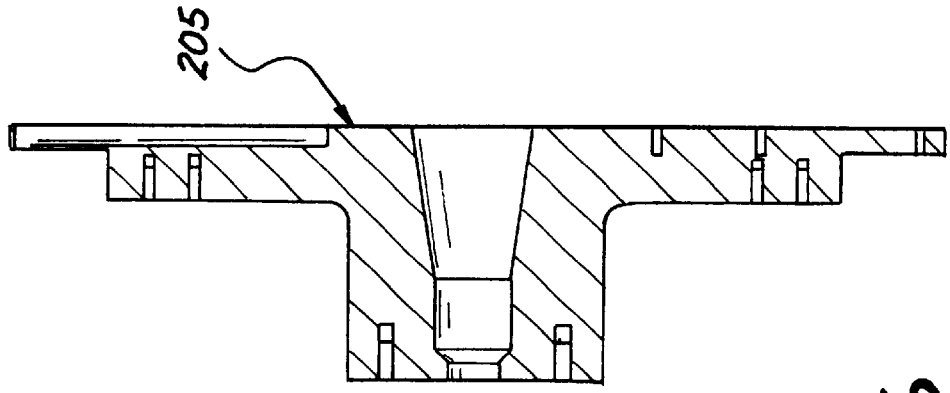
FIG. 26 is a cross-sectional view taken along lines 26—26 of FIG. 25.
Figure 25:
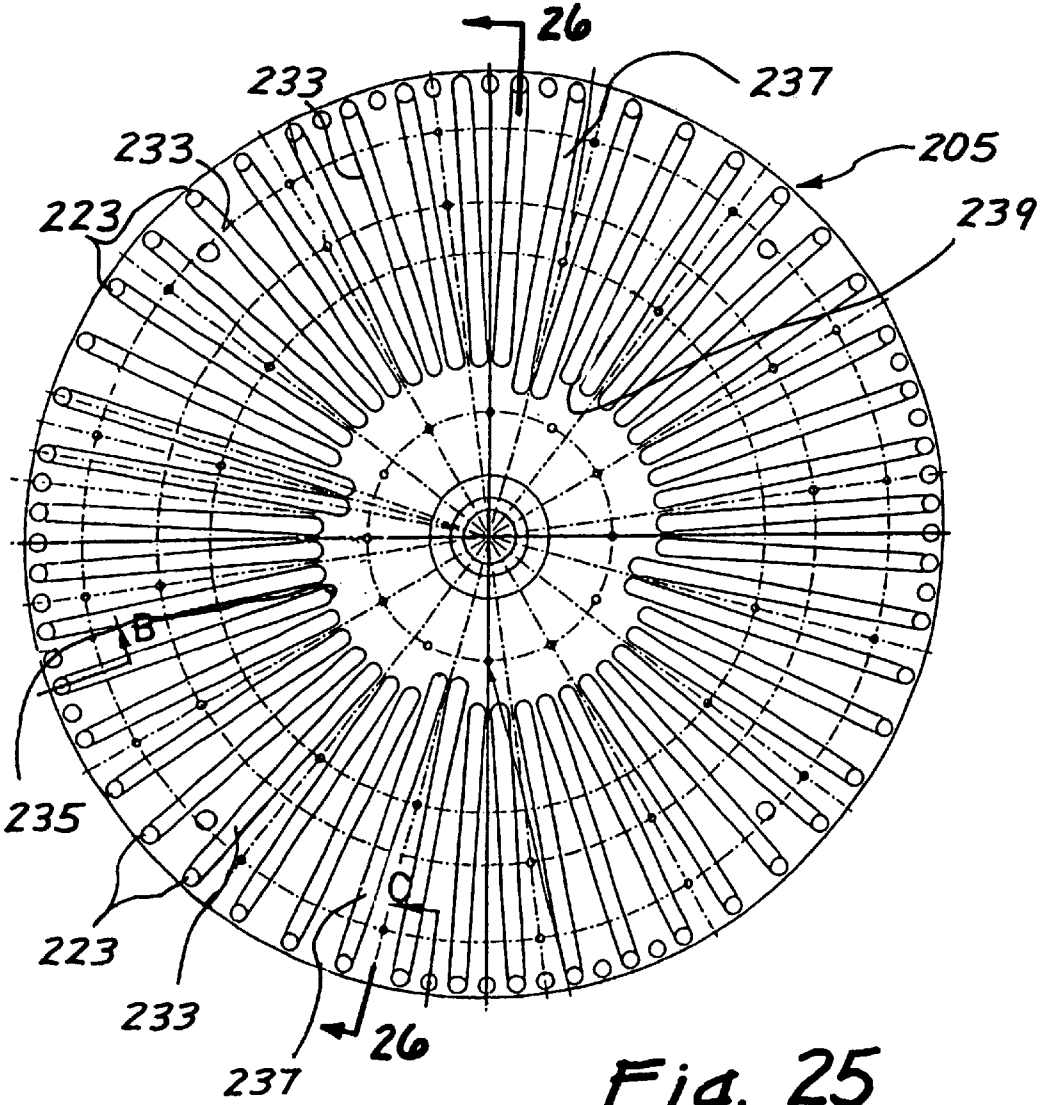
FIG. 25 is a top view of the vacuum drum flange which forms a portion of the vacuum drum assembly of the present invention.
Figure 27:
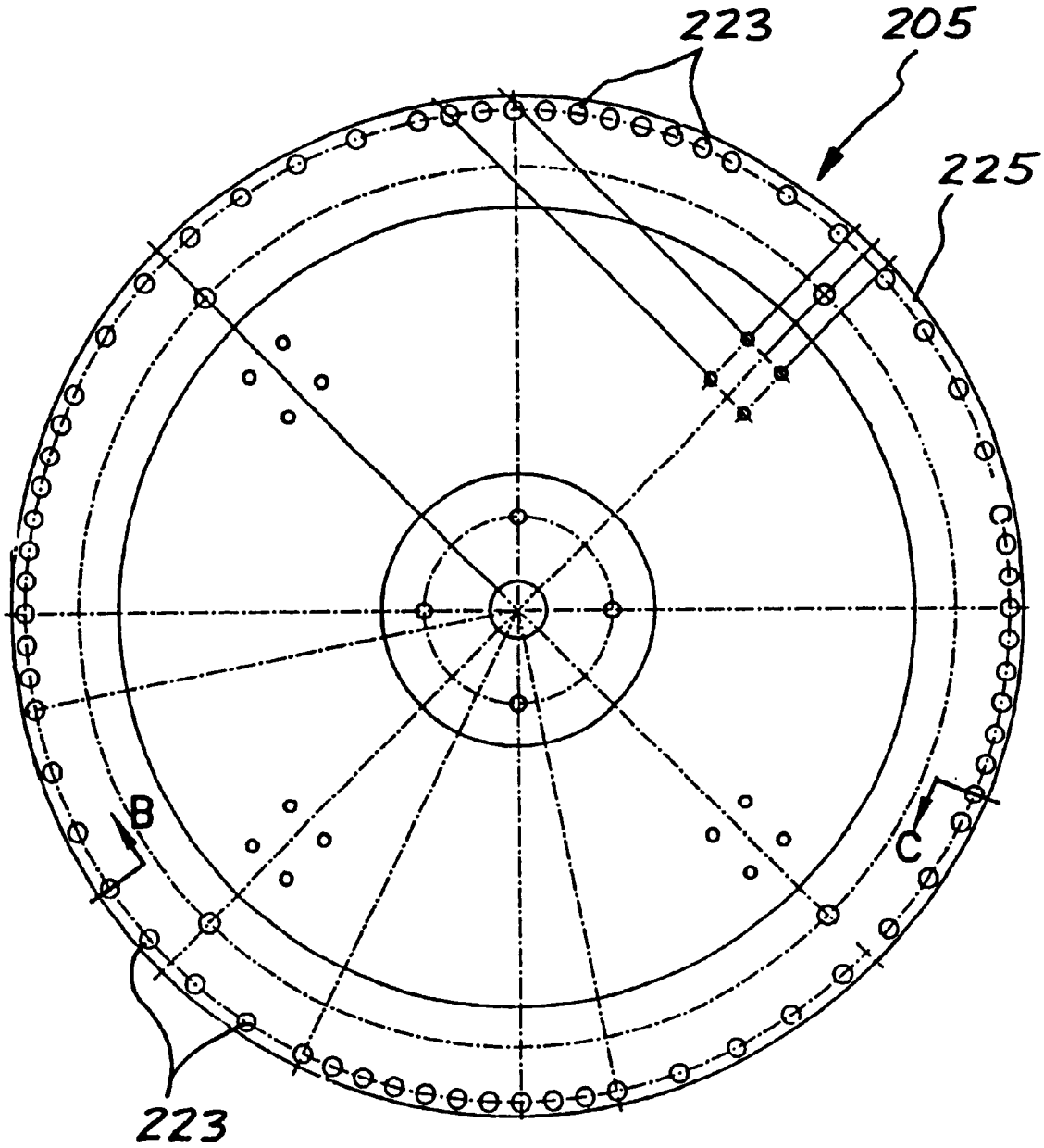
FIG. 27 is a bottom view of the vacuum drum flange illustrated in FIG. 25.
Figure 29:
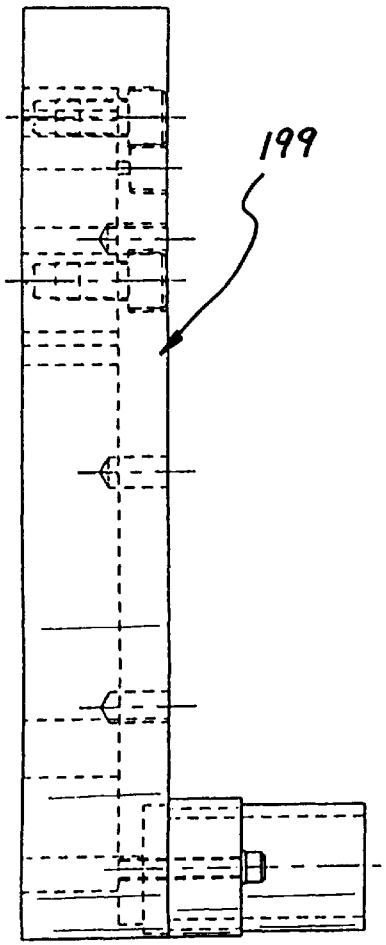
FIG. 29 is a side view of the vacuum valve assembly shown in FIG. 28.
Figure 28:
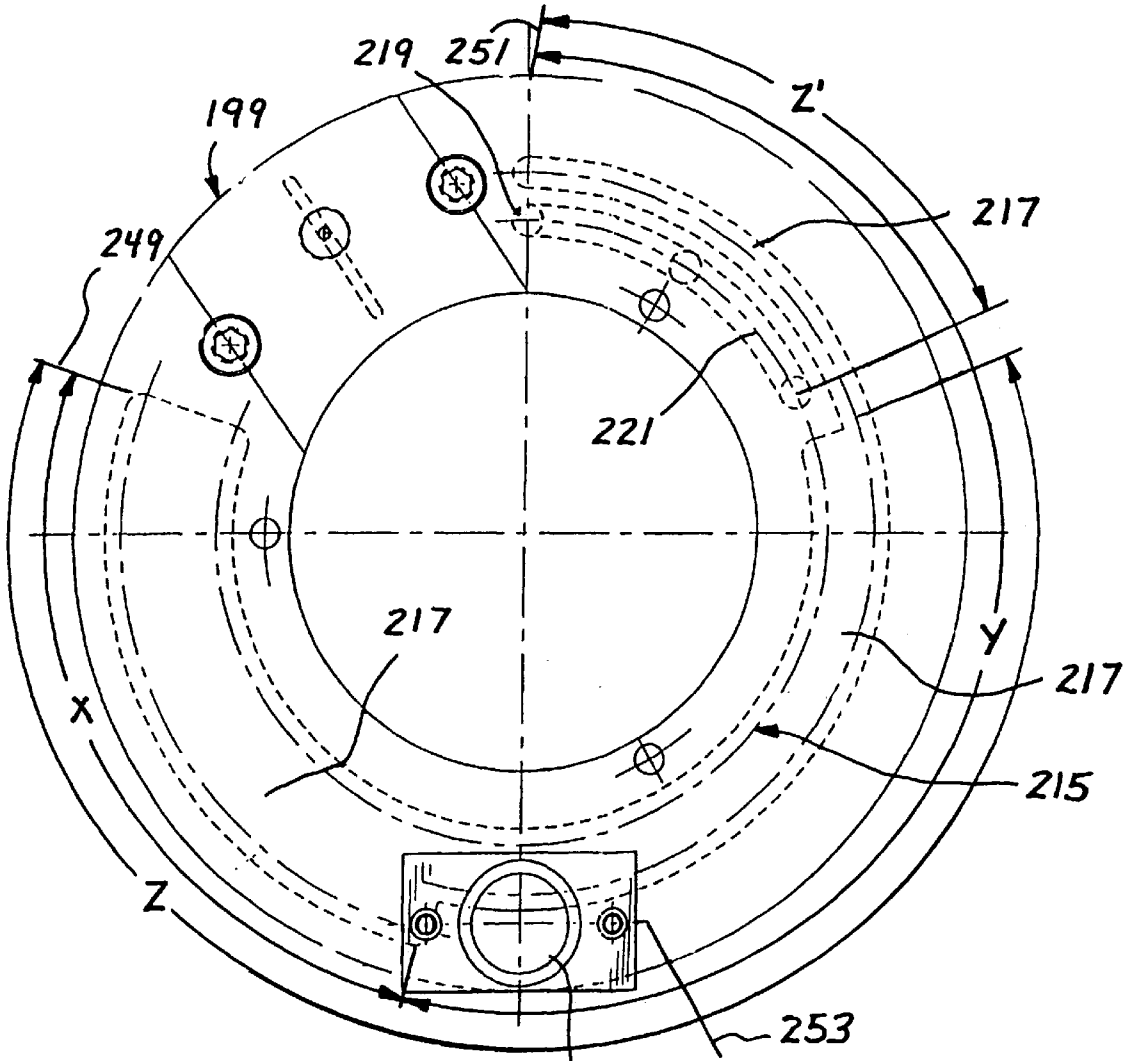
FIG. 28 is a top view of the vacuum valve assembly which forms a portion of the vacuum drum assembly of the present invention.

As illustrated in FIGS. 22 and 23, the vacuum drum assembly 29 preferably comprises a vacuum valve plate 199, which remains stationary and is also shown in greater detail in FIGS. 28 and 29. Above the vacuum valve plate 199 is disposed a vacuum drum flange cover 201, which is illustrated (in reverse orientation) in greater detail in FIGS. 32–34. Situated above the vacuum drum flange cover 201 is a baffle plate 203, which is illustrated in greater detail in FIGS. 30–31. A vacuum drum flange 205 is disposed above the baffle plate 203, and is shown in greater detail in FIGS. 25–27. All but the vacuum valve plate 199 are journalled on a drive shaft 207 which rotatably drives the baffle plate 203, flange cover 201, and flange 205 therewith, in the direction shown by arrow 209. The shaft 207 is driven by a motor or other suitable means (not shown).

The vacuum flow through the vacuum drum assembly will now be described. A vacuum fitting 211 (FIGS. 23 and 38) on the vacuum valve plate 199 is adapted to receive a flow of vacuum through a vacuum hose 213 from the vacuum source 45. The vacuum inflows into a manifold in the valve plate 199, from which it is distributed to a plurality of valve vacuum passages 217. A pressurized air fitting 219 is also provided on the valve plate 199, as shown in FIG. 28, for injection of air into a pressurized air passage 221. The source of pressurized air (not shown), is typically merely available house air.

Figure 32:
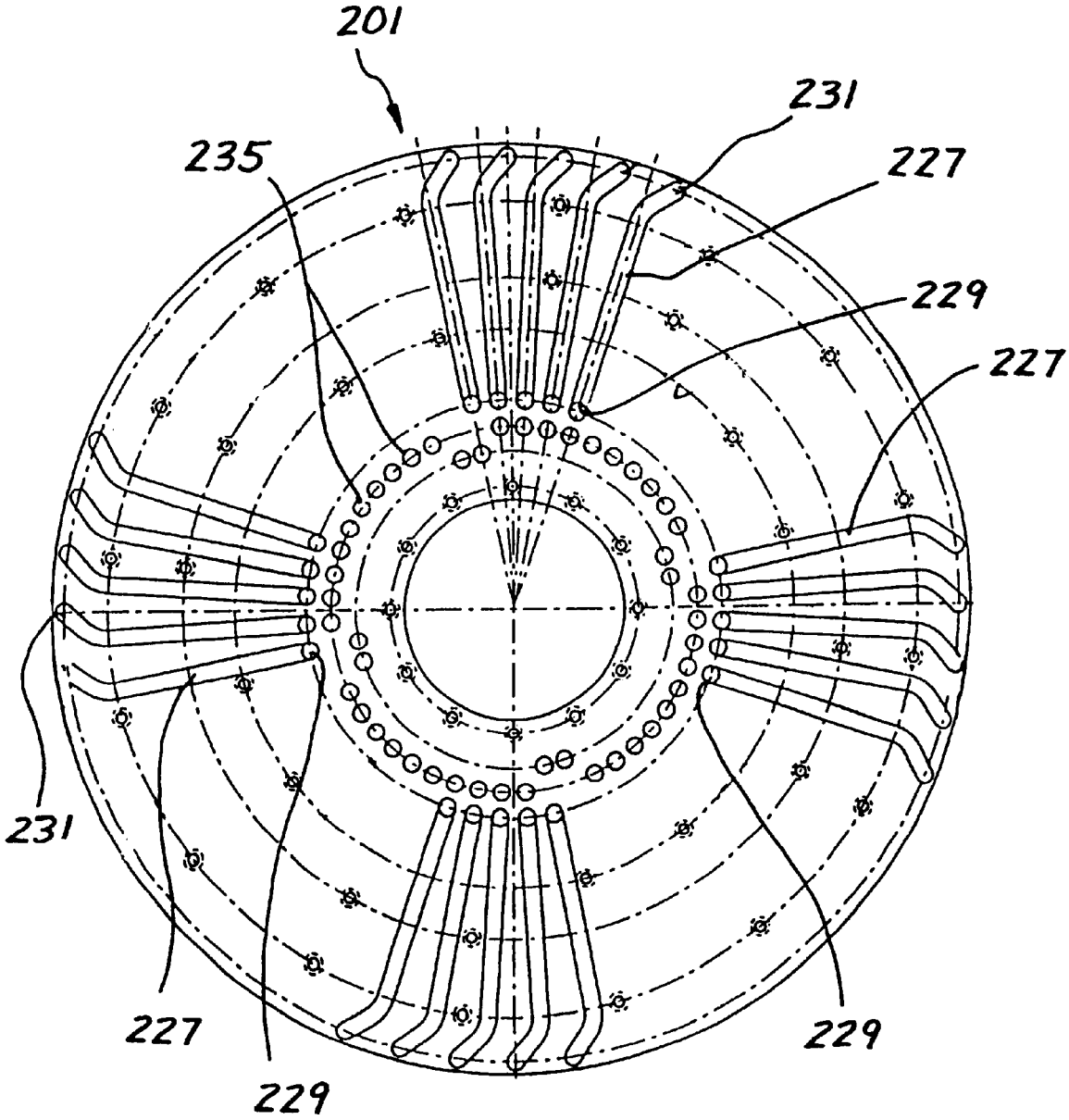
FIG. 32 is a top view of the vacuum drum flange cover which forms a portion of the vacuum drum assembly of the present invention.
Figure 34:
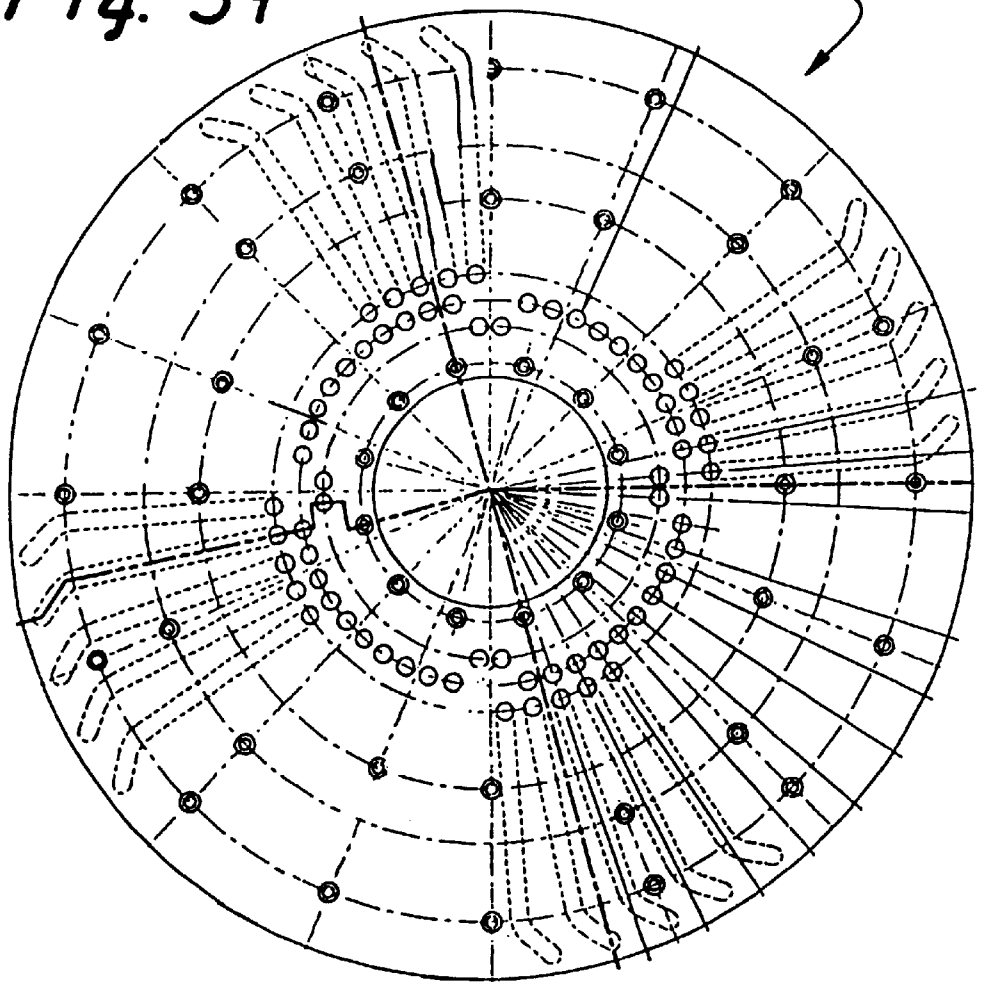
FIG. 34 is a bottom view of the vacuum drum flange cover illustrated in FIG. 32.
Figure 33:
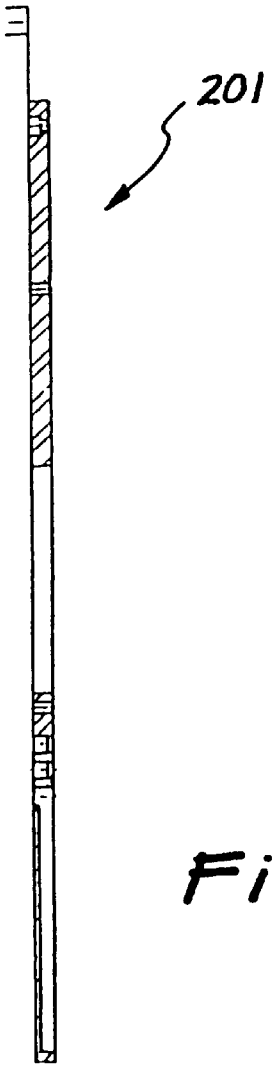
FIG. 33 is a side view of the vacuum drum flange cover illustrated in FIG. 32.

From the valve plate 199, vacuum and/or air is delivered through the vacuum drum flange cover 201 and baffle plate 203 in accordance with the relative position of these elements with respect to the stationary valve plate as they rotate thereover, to a plurality of exit orifices on a label receiving surface 225 of the vacuum drum pad assembly. These apertures are disposed all about the label receiving surface 225 in a predetermined pattern. Referring now to FIGS. 32–34, which illustrate the vacuum drum flange cover 201, a series of slots 227 are adapted to receive vacuum from passages 217 of the valve 199 over periods of time when input ends 229 of those slots 227 are exposed to corresponding portions of the vacuum passages 217 in the valve plate 199, as the flange cover 201 rotates relative thereto. As can be seen from the respective drawings of these elements, during portions of one revolution of the flange cover 201 over the fixed valve plate 199, namely, through the region X shown in FIG. 28, the input ends 229 will be in fluid connection with the vacuum passages 217, and during other portions they will not. The input ends 229 of the slots, as noted by comparison of FIGS. 25, 30, and 32, for example, are at the radially outermost location of three locations having sets of input ends (or, interchangeably, inlet orifices). This permits the inventors to design a suitable flow pattern during a revolution of the vacuum drum assembly 29 to manage the label transfer process, as will be described in additional detail below. It is noted that in the preferred embodiment, the drum provides for four identical label stations, one from each drum segment, so that during each rotation of the drum four labels can be transferred to passing containers 19. When vacuum is present in the slots 227 and in slots 233, defined below, it is delivered to the exit orifices 223 through slot outlets 231. It should be noted, at this juncture, that while a drum comprising four drum segments 232*a*, 232*b*, 232*c*, and 232*d* is disclosed, any number of drum segments, from one to greater than one, may be employed.

Figure 31:
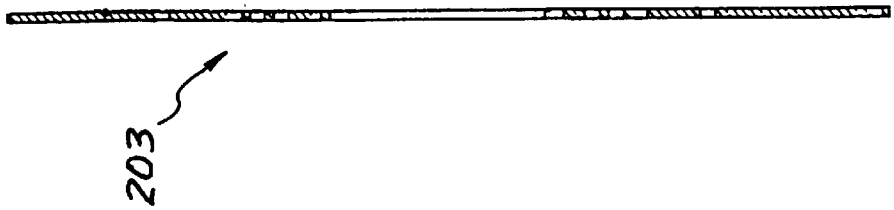
FIG. 31 is a side view of the baffle plate illustrated in FIG. 30.
Figure 30:
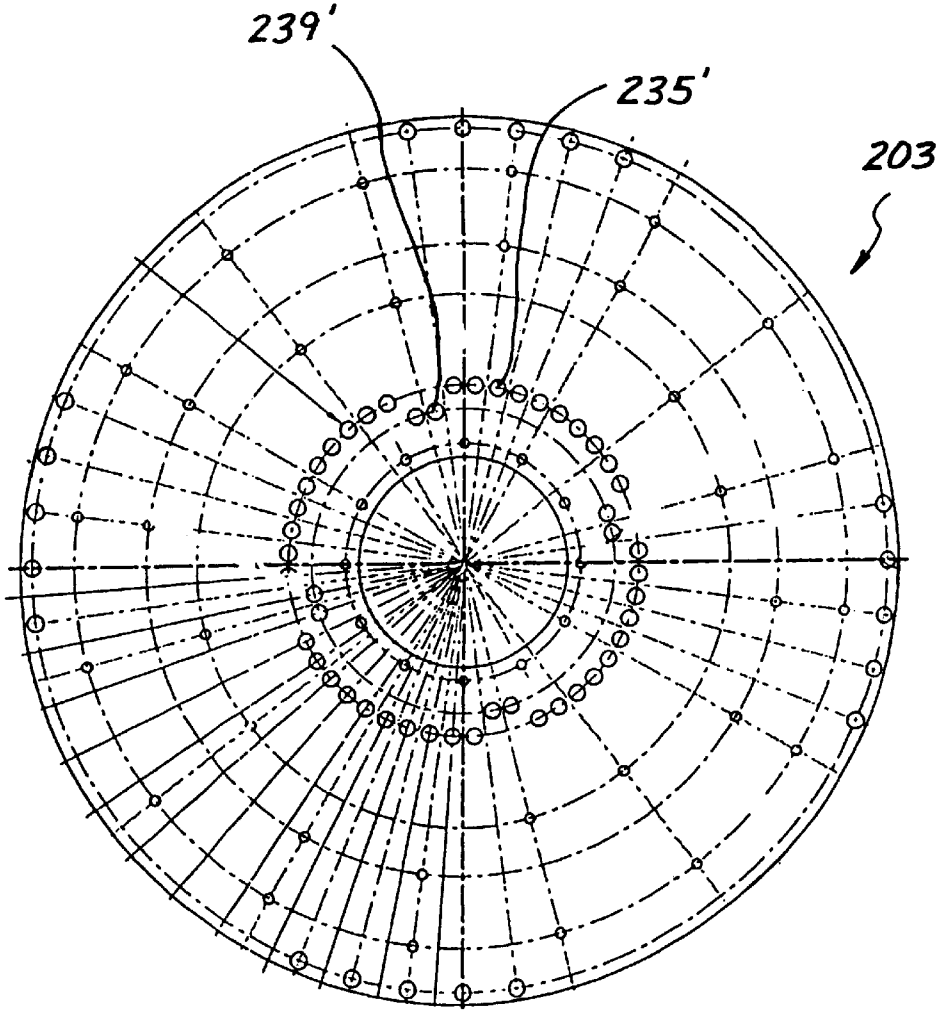
FIG. 30 is a top view of the baffle plate which forms a portion of the vacuum drum assembly of the present invention.

Referring now to FIGS. 30–31, which illustrate the baffle plate 203 in greater detail, the baffle plate preferably comprises ⅛ inch thick aluminum, though other materials can, of course, be used. It includes a plurality of apertures for delivering vacuum and pressurized air from the valve plate 199 to the flange plate 205, and is disposed between the flange cover 201 and flange 205.

Referring now to FIGS. 25–29, the function and structure of the vacuum drum flange 205 will be discussed in greater detail. A plurality of slots 233 extend radially on the flange 205 for delivering vacuum pressure to exit orifices 223. These slots 233 have inlet orifices 235 for receiving vacuum pressure from the valve plate 199 during appropriate predetermined rotational intervals, namely through the regions X and Y as shown in FIG. 28. Longer slots 237 have inlet orifices 239 for receiving, alternatively, vacuum pressure and air pressure during appropriate predetermined rotational intervals. For example, as shown in FIG. 28, the inlet orifices 239 will receive vacuum pressure through the region Z, and air pressure through the region Z'. It is noted that the radial locations of inlet orifices 235 and 239 correspond with the radial locations of apertures 235' and 239', respectively, in the baffle plate 203.

Figure 37:
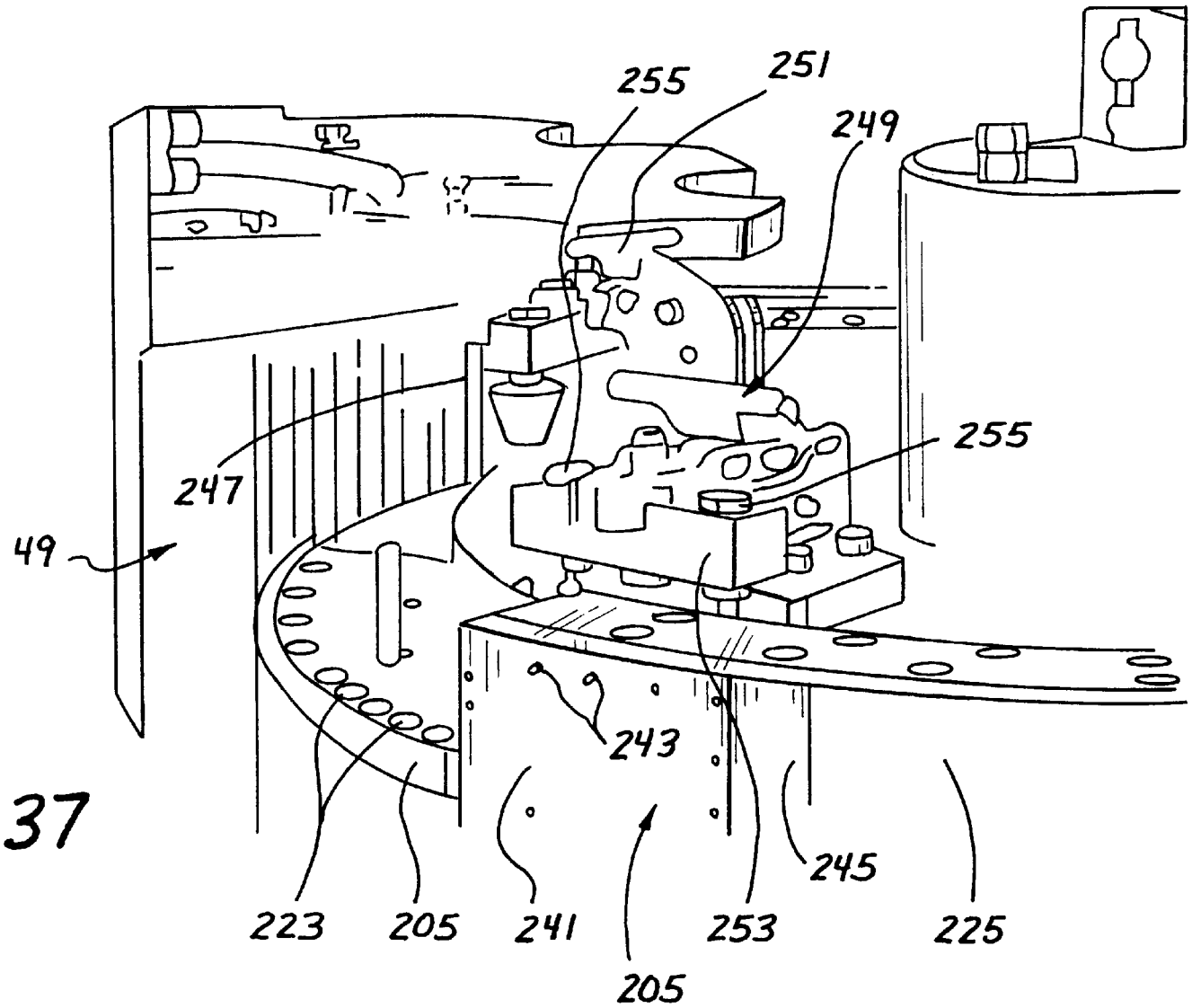
FIG. 37 is perspective view of a portion of the vacuum drum assembly of the present invention.

Functionally, in an exemplary embodiment, as shown in FIG. 37, an upstanding portion of the flange 205 includes a "pre-pad" region which includes a plurality of pre-pad orifices 243. These orifices 243 receive vacuum pressure to hold a cut label thereon initially as it is delivered from the cutter 43 onto the label receiving surface 225. The drum 29 rotates faster than the label speed off of the cutter 43, so the system is designed to have the leading edge of the label contact the pre-pad region initially, and slide back until it hits the leading edge pad 245, at which point the cut is made. At this point, the label speed and drum speed are equivalent, so the label is properly laid down between the leading edge pad 245 and the trailing edge pad 247 (which is illustrated on the next segment).

A problem to be overcome is that, once the label is slid back off of the pre-pad surface, the pre-pad orifices 243 are exposed for the remainder of the revolution of the drum. Since they draw a vacuum, in the past when these pre-pad orifices 243 came into the vicinity of the glue wheel assembly 49, they would ingest glue and frequently become clogged, necessitating frequent downtime. However, because the inventors have now developed the above described innovative three-way (three ported) valving system, it is possible to shut off the pre-pad orifices 243 once the label has been properly positioned. Specifically, in a preferred implementation, the exit apertures 231 of the slots 227 in the flange cover 201 are the only apertures to deliver vacuum to the pre-pad holes 243. Thus, vacuum is shut off to the pre-pad orifices at all other times when they are not in registration with the apertures 231, which include periods when the pre-pad orifices are disposed in the vicinity of the glue wheel 49. Consequently, this vacuum is "on" in region X, and "off" at all other times. The slots 233 of the vacuum drum flange 205 deliver vacuum to the label hold-down orifices between the leading and trailing edge pads. Slots 237 of the vacuum drum flange deliver vacuum or air to the leading edge pad on the receiving surface 225 for receiving the label (vacuum) or blowing it off onto the container 19 (pressure). Referring again to the vacuum valve 199, as shown in FIG. 28, the cutter 49 is located at approximately point 249 on the valve plate 199. No label is in place on the surface 225 between the point 249 (cutter) and point 251, which is when the label is transferred onto a container 19*a*. Thus, no vacuum or air pressure is provided during this interval. The glue wheel is located at approximately point 253.

Another innovative feature of the invention is the use of quick-release clamping mechanisms 249, which, in their preferred embodiments, comprise DeStaco™ clamps, similar to clamps 149 discussed above. These clamps 249 are utilized to secure the four segments 232*a*, 232*b*, 232*c*, and 232*d* of the vacuum drum assembly together, and take them apart during change outs. The segmented vacuum drum allows for lightweight quick change-outs of the vacuum drum pad, for different labeling applications. Positive lever locks 251 provide quick changes and maintain alignment of the drum segments.

Figure 35:
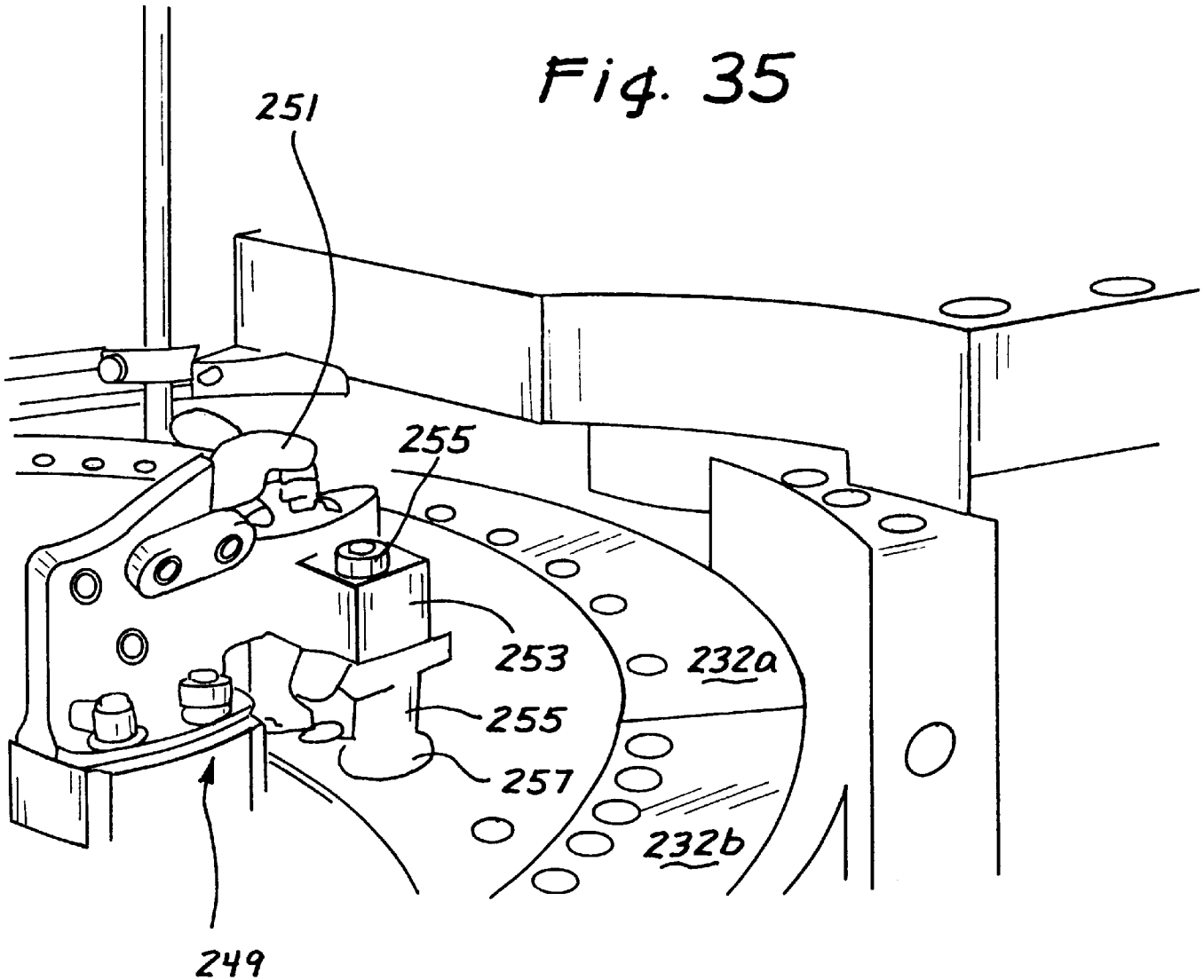
FIG. 35 is a perspective view of a portion of the assembly for securing segments of the vacuum drum assembly together, near the cutter air shoe assembly.
Figure 36:
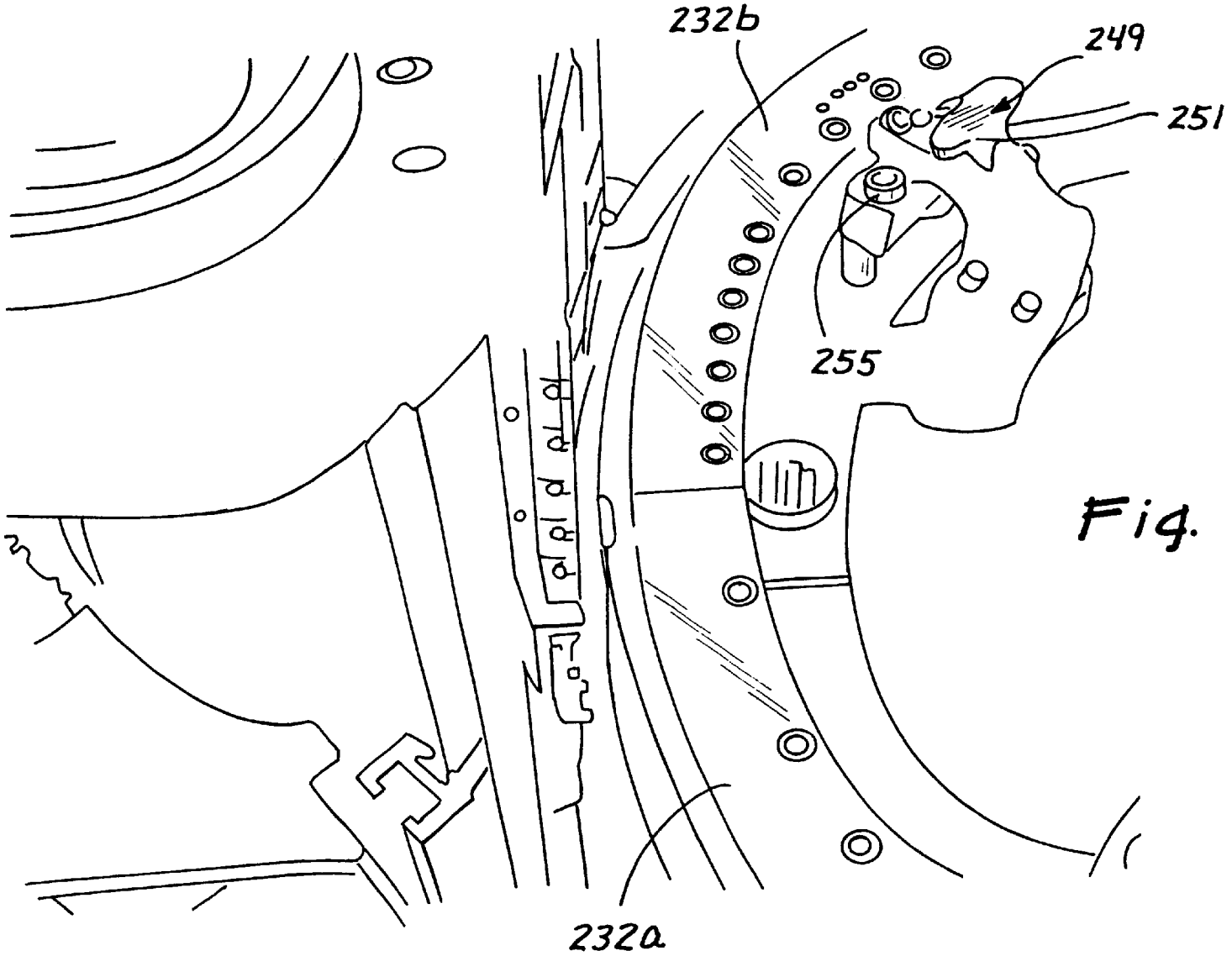
FIG. 36 is a perspective view of the interface between the glue wheel and the vacuum drum assembly, which again illustrates a portion of the assembly for securing segments of the vacuum drum assembly together.

More particularly, each clamping mechanism 249 comprises, in addition to a lever lock or handle 251, a clamping block 253 and a pair of tapered pins 255, one of which is disposed at each opposing end of the clamping block 253, as shown, for example, in FIGS. 23, 35, and 36. The pins 255 are tapered downwardly, to engage hardened metal sleeves 257.

Thus, to change out the segmented vacuum drum pads, an operator need only utilize the pivoting DeStaco clamp to release the segments from the vacuum drum assembly. This is accomplished by lifting the handle 251 to release the clamping mechanism 249. To install the replacement vacuum drum pads, the tapered pins 255 are engaged with the hardened metal sleeves 257, as shown, and the handle is pivoted downwardly to lock the segments in place. Locknuts 259 are supplied to assist in the locking process.

Figure 39:
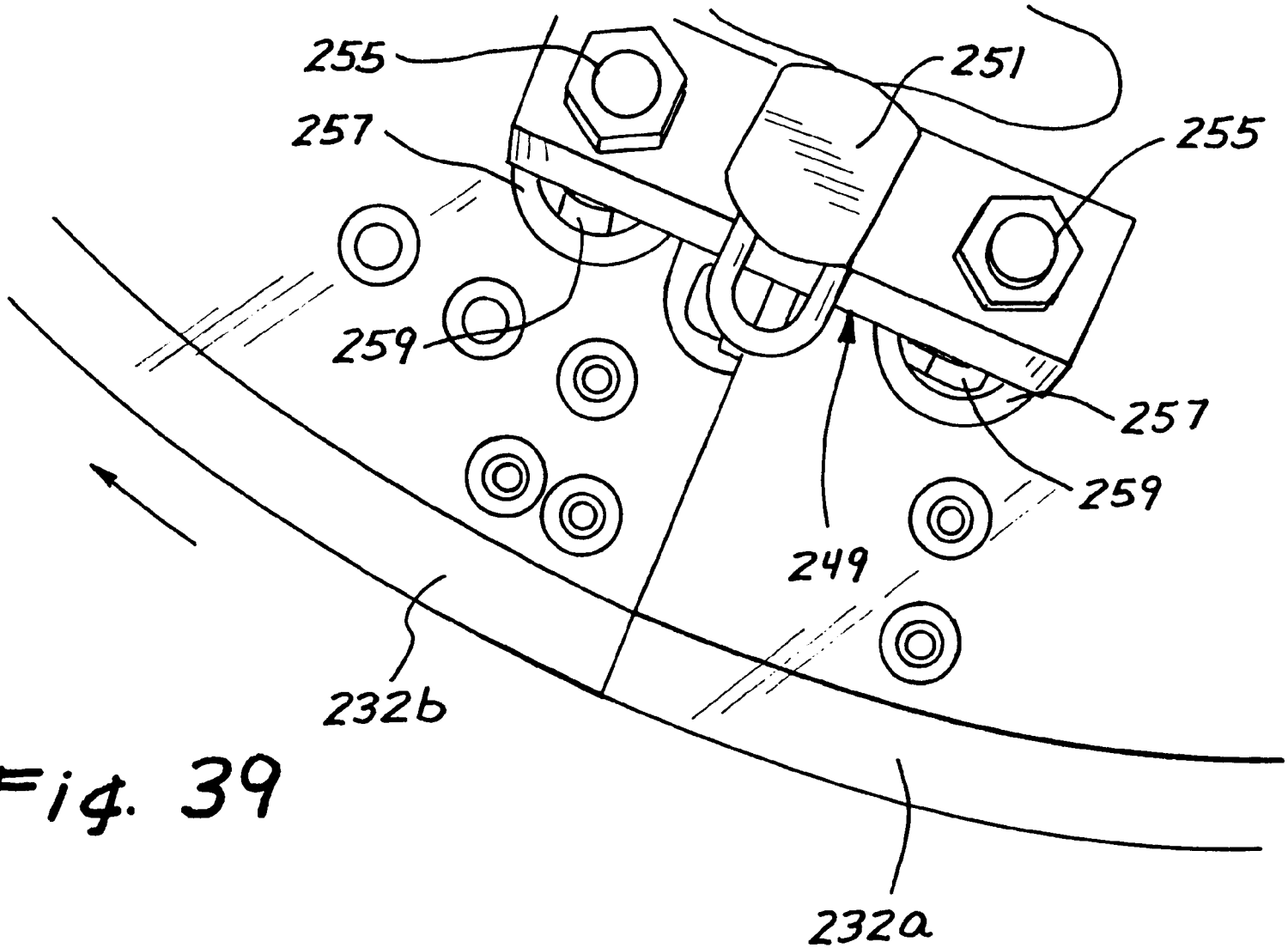
FIG. 39 is a top view illustrating an alternative approach for securing two segments of the vacuum drum assembly together.

The arrangement shown in FIGS. 22 and 36, wherein the clamps 249 are each disposed at a midportion of their respective segments 232*a*, 232*b*, 232*c*, or 232*d*, is presently preferred. However, an alternative arrangement, as is shown in FIG. 39, wherein the clamps 249 are each disposed at the junction between adjacent segments, is also feasible, and is primarily a matter of design preference.

Another innovative feature of the invention as shown in FIG. 2, for example, is the employment of a glue tank 265 which is slidable into and out of the machine housing 13 for re-filling, on drawer slides 267, 269. This is a vast improvement over prior art systems, wherein the glue tank has typically been mounted on the outside of the housing 13. Advantages include a substantially reduced footprint of the machine 11, and greatly increased convenience with respect to re-filling the glue tank, and operating the machine 11.

Figure 42:
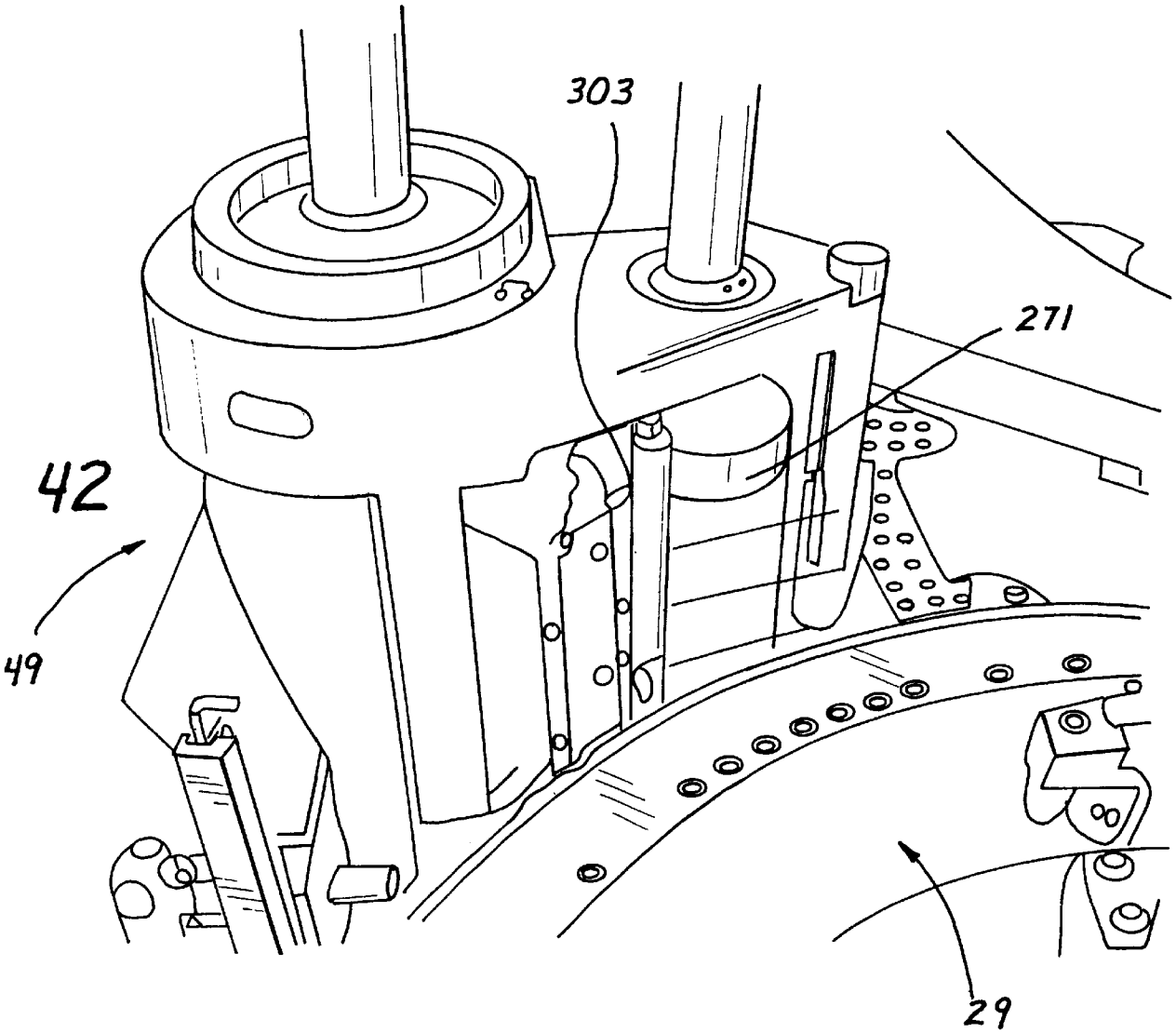
FIG. 42 is a perspective view of the glue wheel to vacuum drum interface in one embodiment of the invention.

Another innovative feature of the invention, as shown particularly in FIGS. 40–42, is the employment of an innovative new glue wheel or gravure wheel assembly 49. This assembly comprises a glue wheel 271 disposed above a glue pan 273. A glue inlet 275 comprises a hose for delivering a supply of glue from the glue tank 265 to the glue wheel 271. As is known in the art, the glue wheel 271 has a pattern of annular cross-hatched grooves (not shown) machined into its surface, which become filled with adhesive from the supply 275. This adhesive is transferred to passing labels disposed on the vacuum drum surface. A plunger 277 is attached to the glue wheel 271 and is movable inwardly and outwardly, toward and away from the label surface on the vacuum drum assembly 49, for the purpose of moving the glue wheel 271 inwardly and outwardly to apply glue selectively to passing labels. An actuator 279 is provided to drive the plunger 277 by means of a piston shaft 281. In a preferred embodiment, this actuator 279 comprises a double-acting air cylinder, driven pneumatically using house air. A unique yoke assembly comprises a top yoke 283 and a bottom yoke 285 which are coupled to one another by means of a support member 287. The air cylinder drive 279 is coupled to the yoke assembly via a clevis 288. The glue wheel 271 and associated glue bar 289 are supportably mounted between the respective yokes 283 and 285, so that when the actuator 279 drives the plunger 277, as described above, the yoke assembly or carriage, moves responsive thereto, thus also moving the glue wheel 271 as desired. The air cylinder drive member 279 is mounted between two bushings 291, 293 disposed on each yoke member 283, 285, which is novel and advantageous because the bushings assist in keeping the load in the center of the yoke assembly in order to resist twisting. The resultant stiff carriage (yokes 283 and 285 in combination) is relatively stiff so that it does not torgue. Preferably, the bushings 291, 293 comprise Oil-Light™ bushings, comprised of oil-impregnated brass.

The glue bar 289 preferably comprises brass, and is disposed against the gravure or glue wheel 271. It is electrically heated, and functions to pick up excess adhesive from the glue wheel passages during operation. Its elevated temperature provides improved function. The glue bar 289 is a wear item, as the glue wheel wears out the brass over time. In the prior art, changing out the glue bar has been a significant headache, because of the need to remove many screws and arm linkages to access and replace the part, as well as to then make adjustments to ensure proper pressure along the length of the glue bar. Failure to properly adjust the installation will cause premature wear. Under normal conditions, changeout of the glue bar is required approximately once per month, and causes down time of approximately 45 minutes to one hour. However, using the present invention, the glue bar 289 is a "quick-change" glue bar. Rather than being disposed on articulated arms, as in the prior art, it is disposed in a channel, and merely slides in and out when changed. Specifically, as shown in FIGS. 41 and 42, in particular, four screws 295 are removed, so that a cover plate 297 may be removed to gain access to a channel 299. The plunger 277 is then loosened by means of adjusting knob 301 in order to relieve spring pressure on the glue bar, so that it may be slid back through the channel 299 and removed. The internal cartridge heater (not shown) may then be removed from the core of the old glue bar and inserted into the core of a new glue bar. The new glue bar may then be installed by following the same procedural steps in reverse order.

Figure 43:
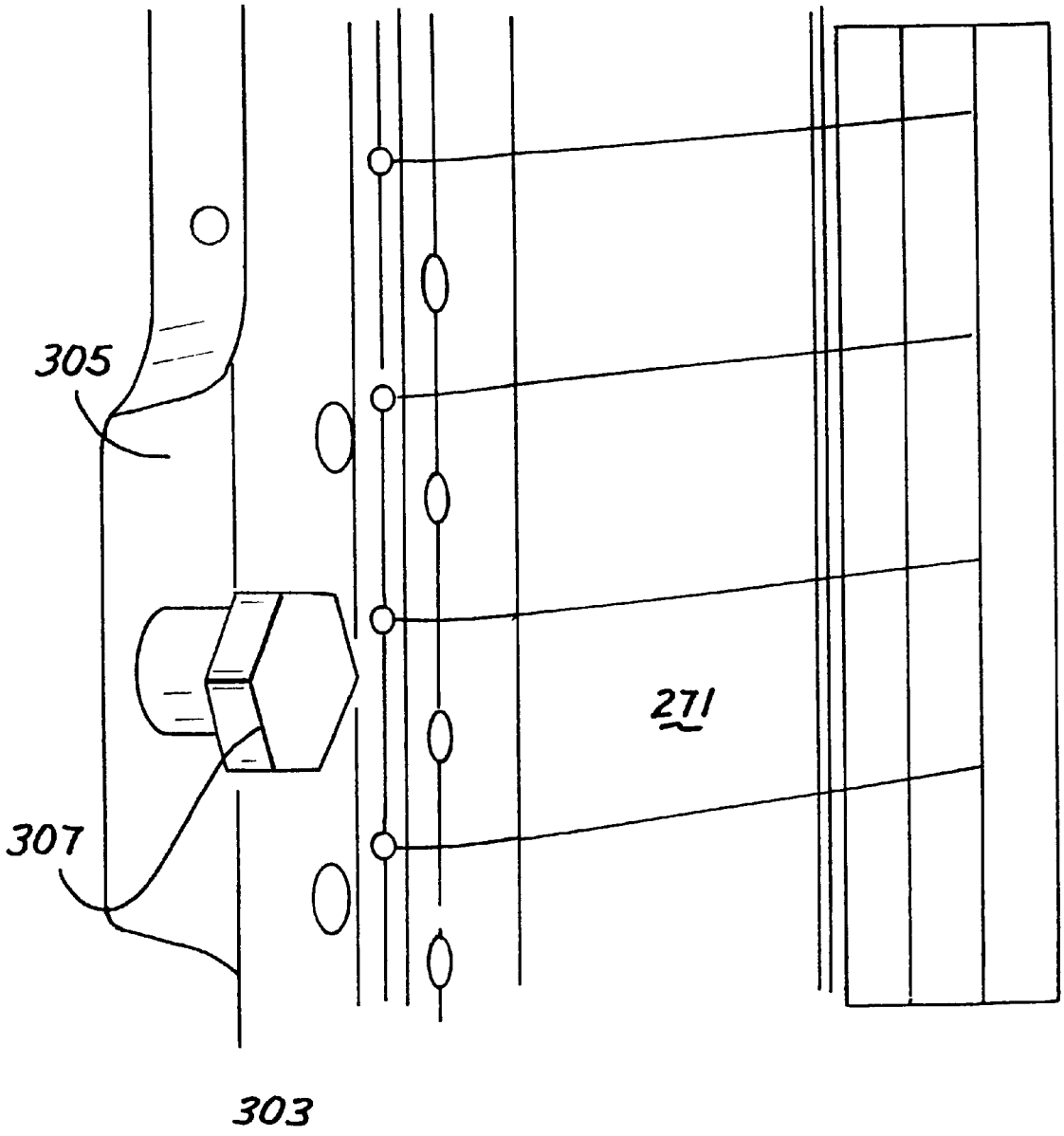
FIG. 43 is a perspective view of the auxiliary glue scraper of the present invention.
Figure 44:
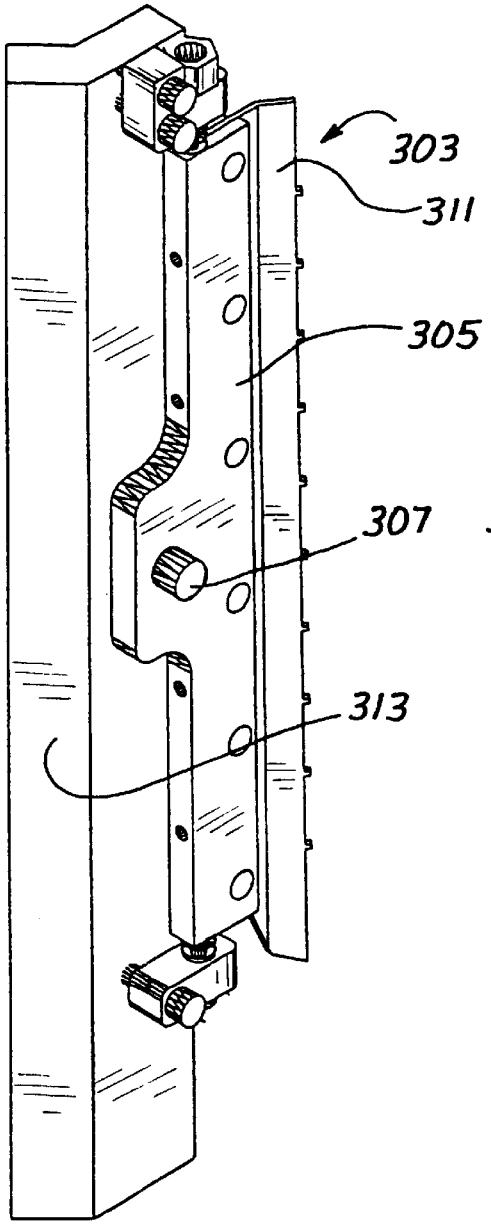
FIG. 44 is another perspective view, in isolation, of the auxiliary glue scraper of the present invention.
Figure 45:
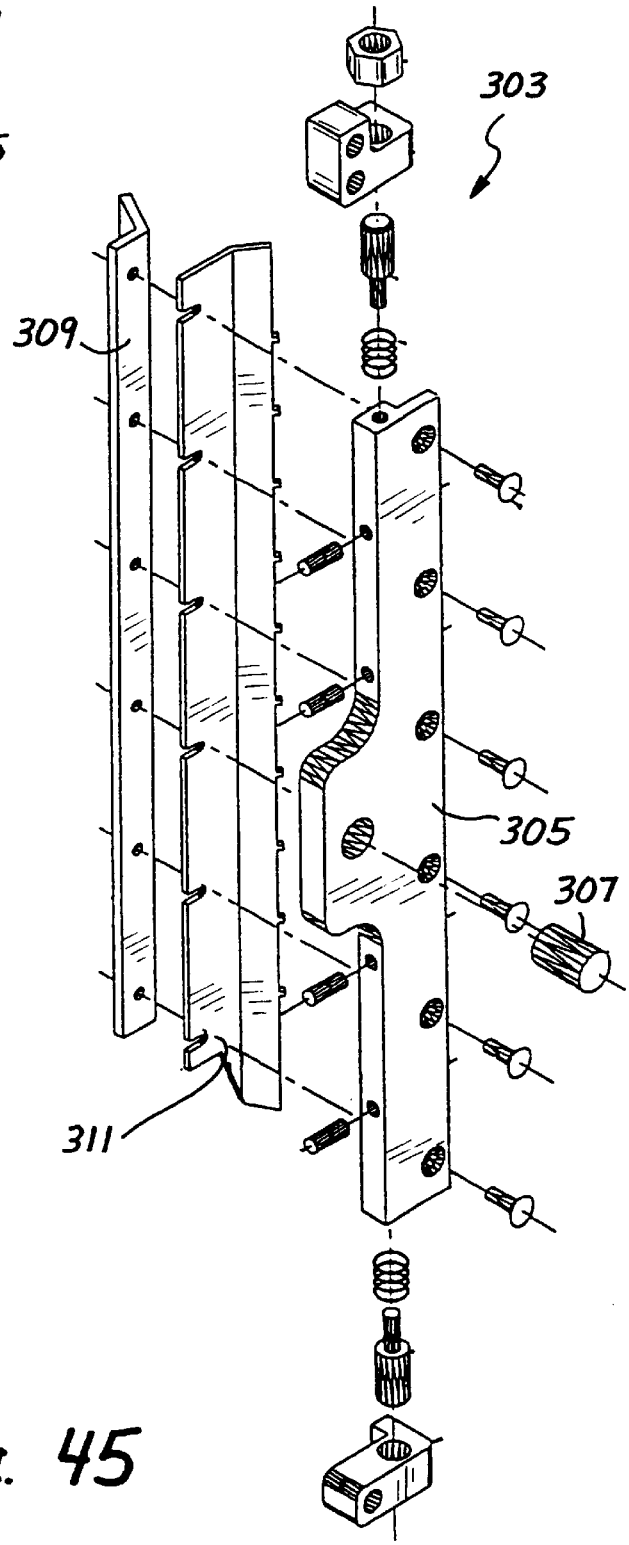
FIG. 45 is an exploded view of the auxiliary glue scraper as shown in FIG. 44

Another advantageous feature of the present invention is the implementation of a "doctoring blade" or auxiliary glue scraper 303 for the purpose of reducing glue slinging from the glue wheel 271. The auxiliary glue scraper 303 is preferably comprised of brass, about 0.08 inches thick, and is pivotable in order to adjust its distance from the glue wheel 271 to scrape off desired excess glue therefrom, and thereby significantly improve glue patterns. The doctoring blade 303 is captured within a mount 305 so that when the mount moves with movement of a screw 307, the blade 303 pivots. Details of the blade 303 are shown in FIGS. 43–45, wherein it may be seen that the blade comprises a nut plate 309 together with a blade portion 311, in addition to the aforementioned elements, and is installed on a support bar 313.

The apparatus and method of the present invention may be embodied in other specific forms without departing from its spirit or essential characteristics. The described embodiments are to be considered in all respects only as illustrative and not restrictive.

What is claimed is:

1. A quick change roll-fed high speed labeling system, comprising:

a conveyor for moving articles to be labeled;

an infeed screw assembly for spacing and stabilizing said articles;

a rotatable starwheel assembly having a plurality of spaced pockets for receiving individual ones of said articles therein, said starwheel assembly comprising a plurality of segments for permitting convenient change-out when necessary;

a rotatable vacuum drum assembly; and a supply of roll fed labels, wherein said labels are dispensed singly onto a label receiving face of said rotatable vacuum drum assembly.

2. A quick change roll-fed high speed labeling system, comprising:

a conveyor for moving articles to be labeled;

an infeed screw assembly for spacing and stabilizing said articles;

a rotatable starwheel assembly having a plurality of spaced pockets for receiving individual ones of said articles therein;

a rotatable vacuum drum assembly comprising a plurality of segments for convenient change-out when necessary; and a supply of roll fed labels, wherein said labels are dispensed singly onto a label receiving face of said rotatable vacuum drum assembly.

* * * * *